US008806792B2

(12) United States Patent
Yan et al.

(10) Patent No.: US 8,806,792 B2
(45) Date of Patent: Aug. 19, 2014

(54) FIREARM HANDGUARD COMPONENTS, ASSEMBLY AND METHOD FOR FORMING THE SAME

(71) Applicant: Leapers, Inc., Livonia, MI (US)

(72) Inventors: Yuedong Yan, Novi, MI (US); Tai-Lai Ding, Northville, MI (US)

(73) Assignee: Leapers, Inc., Livonia, MI (US)

( * ) Notice: Subject to any disclaimer, the term of this patent is extended or adjusted under 35 U.S.C. 154(b) by 0 days.

(21) Appl. No.: 13/789,138

(22) Filed: Mar. 7, 2013

(65) Prior Publication Data

US 2014/0026459 A1 Jan. 30, 2014

Related U.S. Application Data

(60) Provisional application No. 61/676,756, filed on Jul. 27, 2012.

(51) Int. Cl.
*F41C 23/16* (2006.01)

(52) U.S. Cl.
CPC ..... *F41C 23/16* (2013.01)
USPC ..... 42/71.01; 42/75.02

(58) Field of Classification Search
USPC ..... 42/71.01, 75.02
See application file for complete search history.

(56) References Cited

U.S. PATENT DOCUMENTS

| | | | | |
|---|---|---|---|---|
| 5,412,895 | A | 5/1995 | Krieger | |
| 6,959,509 | B2 | 11/2005 | Vais | |
| 8,479,429 | B2 * | 7/2013 | Barrett et al. | 42/75.02 |
| 8,490,312 | B2 * | 7/2013 | Barrett et al. | 42/75.02 |
| 8,505,227 | B2 * | 8/2013 | Barrett et al. | 42/75.02 |
| D692,516 | S * | 10/2013 | Yan et al. | D22/108 |
| 2007/0017139 | A1 | 1/2007 | Larue | |
| 2010/0319231 | A1 | 12/2010 | Stone et al. | |
| 2011/0061281 | A1 | 3/2011 | Kapusta et al. | |
| 2012/0186123 | A1 | 7/2012 | Troy et al. | |

* cited by examiner

*Primary Examiner* — Michael David
(74) *Attorney, Agent, or Firm* — Honigman Miller Schwartz and Cohn LLP

(57) ABSTRACT

A firearm handguard assembly attachable to a receiver of a barrel of a firearm is disclosed. The firearm handguard assembly includes a barrel nut member, a locking sleeve member, a firearm handguard member and a plurality of fasteners. The locking sleeve member is disposed within an axial passage formed by the barrel nut member. A plurality of radial passages of the locking sleeve member are aligned with a plurality of radial passages of the barrel nut member. The firearm handguard member is arranged about the barrel nut member and the locking sleeve member such that the barrel nut member and the locking sleeve member are arranged within an axial passage of the firearm handguard member. The plurality of fasteners join the firearm handguard member to the barrel nut member and the locking sleeve member.

29 Claims, 23 Drawing Sheets

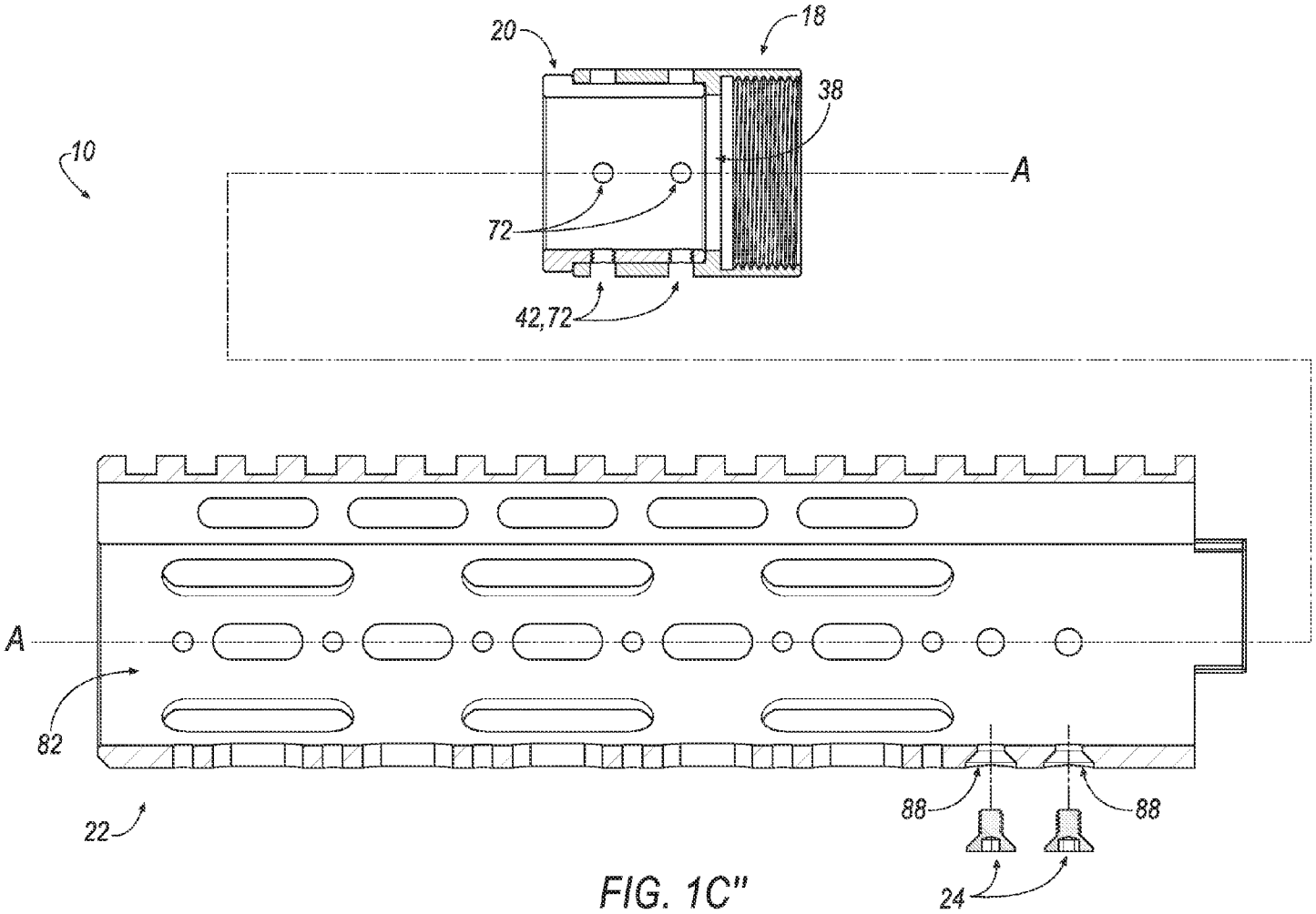
FIG. 1C"

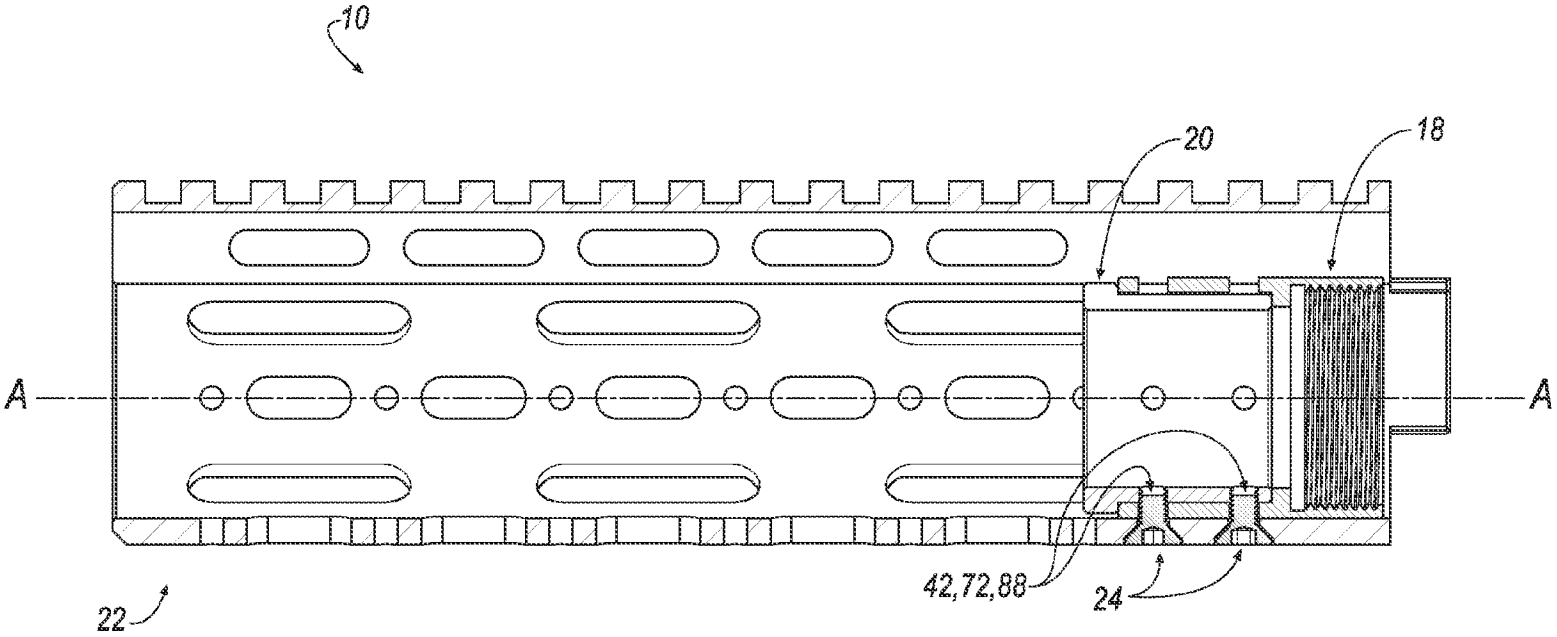
FIG. 1C''''

FIREARM HANDGUARD COMPONENTS, ASSEMBLY AND METHOD FOR FORMING THE SAME

CROSS-REFERENCE TO RELATED APPLICATIONS

This U.S. Patent Application claims priority to U.S. Provisional Application: 61/676,756 filed on Jul. 27, 2012, the disclosure of which is considered part of the disclosure of this application and is hereby incorporated by reference in its entirety.

TECHNICAL FIELD

The disclosure relates to firearm handguard components, an assembly and method for forming the same.

BACKGROUND

Firearm handguards are known in the art. Improvements to firearm handguards are continuously being sought in order to advance the art.

DESCRIPTION OF THE DRAWINGS

The disclosure will now be described, by way of example, with reference to the accompanying drawings, in which.

SUMMARY

Figure 1A:
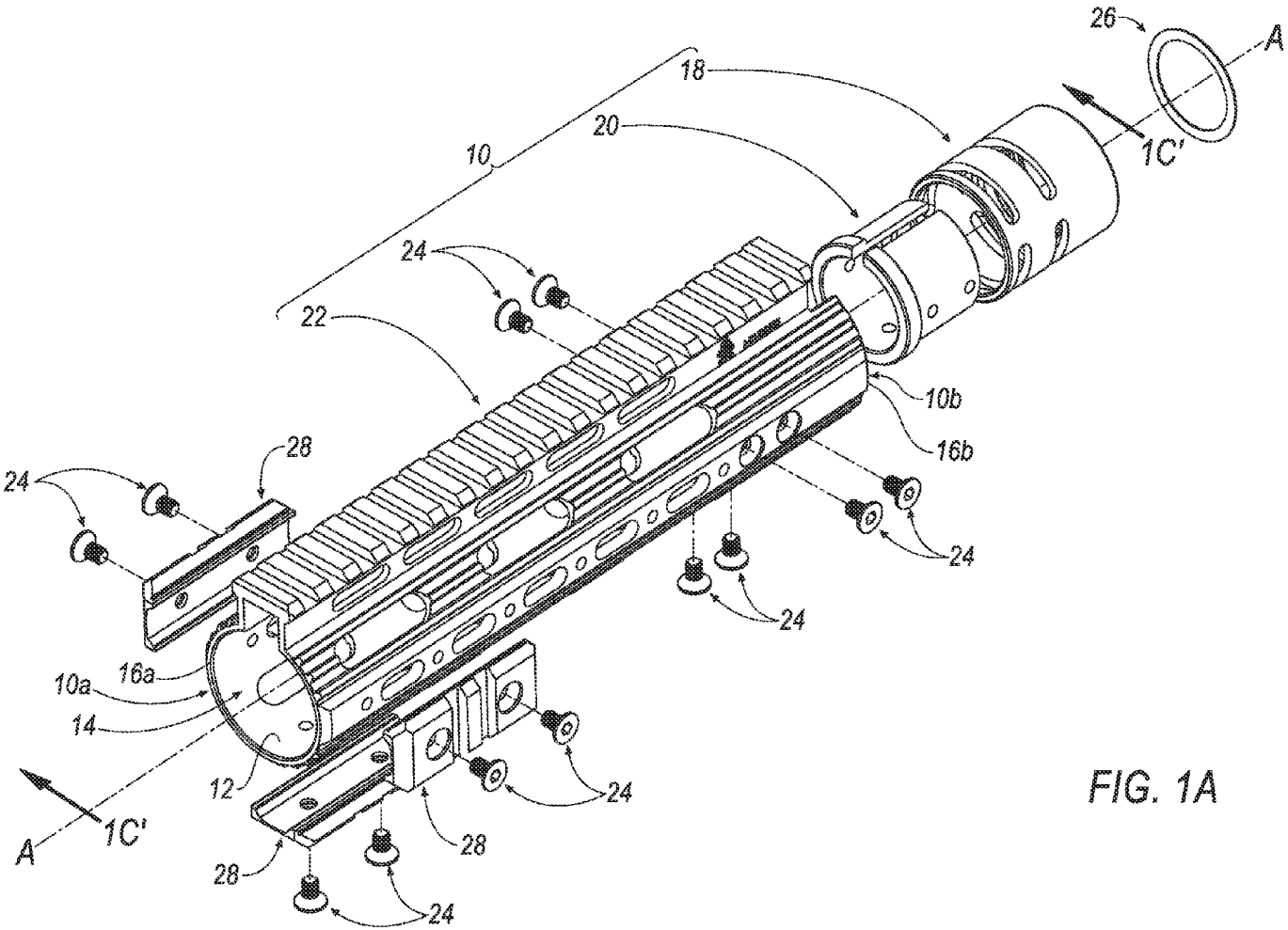
FIG. 1A is an exploded view of a plurality of components forming an exemplary firearm handguard assembly.

One aspect of the disclosure provides a firearm handguard assembly attachable to a receiver of a barrel of a firearm. The firearm handguard assembly includes a barrel nut member, a locking sleeve member, a firearm handguard member and plurality of fasteners. The locking sleeve member is disposed within an axial passage formed by the barrel nut member. A plurality of radial passages of the locking sleeve member are aligned with a plurality of radial passages of the barrel nut member. The firearm handguard member is arranged about the barrel nut member and the locking sleeve member such that the barrel nut member and the locking sleeve member are arranged within an axial passage of the firearm handguard member. A plurality of radial passages of the firearm handguard member are aligned with the plurality of radial passages of the locking sleeve member and the plurality of radial passages of the barrel nut member. The plurality of fasteners extend through the plurality of radial passages of the barrel nut member, the locking sleeve member and the firearm handguard member for joining the firearm handguard member to the barrel nut member and the locking sleeve member.

In some examples, the plurality of fasteners are inserted: firstly through the plurality of radial passages of the firearm handguard member, then secondly through the plurality of radial passages of the barrel nut member and then thirdly through the plurality of radial passages of the locking sleeve member for joining the firearm handguard member to the barrel nut member and the locking sleeve member.

In some implementations, the plurality of radial passages of the locking sleeve member extend through a thickness of the locking sleeve member such that the plurality of radial passages of the locking sleeve member are in fluid communication with an axial passage that extends through the length of the locking sleeve member.

In some instances, the plurality of radial passages of the firearm handguard member extend through a thickness of the firearm handguard member such that the plurality of radial passages of the firearm handguard member are in fluid communication with an axial passage that extends through the length of the firearm handguard member.

In some examples, the plurality of radial passages of the barrel nut member includes a first radial passage, a second radial passage, a third radial passage and a fourth radial passage. The first radial passage and the second radial passage are arranged in an opposing relationship to thereby define the substantially tube-shaped body to include a first substantially circumferential passage. The third radial passage and the fourth radial passage are arranged in an opposing relationship to thereby define the substantially tube-shaped body to include a second substantially circumferential passage. The first substantially circumferential passage and the second substantially circumferential passage are spaced apart by a first spaced-apart distance.

In some implementations, the plurality of radial passages of the locking sleeve member include six radial passages defined by: a first pair of radial passages defined by a first radial passage and a second radial passage, a second pair of radial passages defined by a third radial passage and a fourth radial passage, and a third pair of radial passages defined by a fifth radial passage and a sixth radial passage, wherein each passage of the first, second and third pairs of passages of the locking sleeve member are spaced apart by a second spaced-apart distance. The second spaced-apart distance is approximately equal to the first spaced-apart distance.

In some instances, each of the first pair of radial passages of the locking sleeve member and the third pair of radial passages of the locking sleeve member are offset by approximately 90° from the second pair of radial passages of the locking sleeve member.

In some examples, the first pair of radial passages of the locking sleeve member are arranged at a 3 o'clock position of the locking sleeve member. The second pair of radial passages of the locking sleeve member are arranged at a 6 o'clock position of the locking sleeve member. The third pair of radial passages of the locking sleeve member are arranged at a 9 o'clock position of the locking sleeve member.

In some implementations, the plurality of radial passages of the firearm handguard member include six radial passages defined by: a first pair of radial passages defined by a first radial passage and a second radial passage, a second pair of radial passages defined by a third radial passage and a fourth radial passage, and a third pair of radial passages defined by a fifth radial passage and a sixth radial passage. Each passage of the first, second and third pairs of passages of the firearm handguard member are spaced apart by a third spaced-apart distance. The third spaced-apart distance is approximately equal to each of the second spaced-apart distance and the first spaced-apart distance.

In some instances, each of the first pair of radial passages of the firearm handguard member and the third pair of radial passages of the firearm handguard member are offset by approximately 90° from the second pair of radial passages of the firearm handguard member.

In some examples, the first pair of radial passages of the firearm handguard member are arranged at a 3 o'clock position of the firearm handguard member. The second pair of radial passages of the firearm handguard member are arranged at a 6 o'clock position of the firearm handguard member. The third pair of radial passages of the firearm handguard member are arranged at a 9 o'clock position of the firearm handguard member.

In some implementations, the barrel nut member is defined by a substantially tube-shaped body having a distal end surface, a proximal end surface, an inner axial passage surface and an outer side surface.

In some instances, each radial passage of the plurality of radial passages of the barrel nut member defines an arcuate-shaped dimension that extends along slightly less than about 180° of the substantially tube-shaped body.

In some examples, the inner axial passage surface of the barrel nut member includes a threaded surface portion that corresponds to and is threadingly-connectable with a threaded surface of the receiver of the firearm.

In some implementations, the substantially tube-shaped body defines the barrel nut member to include a length including a first length portion extending away from the distal end surface of the substantially tube-shaped body and a second length portion extending away from the proximal end surface of the substantially tube-shaped body. The substantially tube-shaped body defines a thickness of the barrel nut member extending between the inner axial passage surface and the outer side surface. The inner axial passage surface of the barrel nut member defines the axial passage of the barrel nut member that extends through the length of the barrel nut member between the distal end surface of the substantially tube-shaped body and the proximal end surface of the substantially tube-shaped body. The axial passage of the barrel nut member is permitted by a distal axial opening formed by the distal end surface of the substantially tube-shaped body and a proximal axial opening formed by the proximal end surface of the substantially tube-shaped body.

In some instances, the first length portion of the barrel nut member includes the plurality of radial passages of the barrel nut member. The plurality of radial passages extend through the thickness of the barrel nut member such that the plurality of radial passages are in fluid communication with the axial passage that extends through the length of the barrel nut member.

In some examples, the locking sleeve member forms a radial passage that extends along an entire length locking sleeve member.

In some implementations, the radial passage is arranged at a 12 o'clock position of the locking sleeve member.

In some instances, the locking sleeve member is defined by a substantially circumferential lip portion and a substantially tube-shaped body portion connected to the substantially circumferential lip portion. The substantially circumferential lip portion defines a distal end surface of the locking sleeve member. The substantially tube-shaped body portion defines a proximal end surface of the locking sleeve member. Both of the substantially circumferential lip portion and the substantially tube-shaped body portion define an inner axial passage surface of the locking sleeve member. Both of the substantially circumferential lip portion and the substantially tube-shaped body portion define an outer side surface of the locking sleeve member. The substantially circumferential lip portion includes a ledge surface that connects a first portion of the outer side surface that is defined by the substantially circumferential lip portion to a second portion of the outer side surface that is defined by the substantially tube-shaped body portion. The ledge surface demarcates the substantially circumferential lip portion from the substantially tube-shaped body portion.

In some examples, the locking sleeve member includes a length. The substantially circumferential lip portion of the locking sleeve member defines a first length portion of the length of the locking sleeve member that extends away from the distal end surface of the locking sleeve member. The substantially tube-shaped body portion of the locking sleeve member defines a second length portion of the length of the locking sleeve member that extends away from the proximal end surface of the locking sleeve member. The substantially circumferential lip portion defines a first thickness of the locking sleeve member extending between the inner axial passage surface and the outer side surface. The substantially tube-shaped body portion defines a second thickness of the locking sleeve member extending between the inner axial passage surface and the outer side surface. The first thickness of the locking sleeve member is greater than the second thickness of the locking sleeve member.

In some implementations, the inner axial passage surface of the locking sleeve member defines an axial passage that extends through the length of the locking sleeve member between the distal end surface of the locking sleeve member and the proximal end surface of the locking sleeve member. Access to the axial passage of the locking sleeve member is permitted by a distal axial opening formed by the distal end surface of the substantially circumferential lip portion and a proximal axial opening formed by the proximal end surface of the substantially tube-shaped body portion.

In some instances, the firearm handguard member is defined by a substantially tube-shaped body having a distal end surface, a proximal end surface, an inner axial passage surface and an outer side surface. The substantially tube-shaped body of the firearm handguard member defines a length of the firearm handguard member. The length of the firearm handguard member includes a first length portion extending away from the distal end surface of the substantially tube-shaped body and a second length portion extending away from the proximal end surface of the substantially tube-shaped body. The substantially tube-shaped body defines a thickness of the firearm handguard member extending between the inner axial passage surface of the firearm handguard member and the outer side surface of the firearm handguard member. The inner axial passage surface of the firearm handguard member defines an axial passage of the firearm handguard member that extends through the length of the firearm handguard member between the distal end surface of the substantially tube-shaped body and the proximal end surface of the substantially tube-shaped body. Access to the axial passage of the firearm handguard member is permitted by a distal axial opening formed by the distal end surface of the substantially tube-shaped body of the firearm handguard member and a proximal axial opening formed by the proximal end surface of the substantially tube-shaped body of the firearm handguard member.

In some examples, the first length portion of the length of the firearm handguard member includes a plurality of repeating radial passages that extend through the thickness of the firearm handguard member such that the plurality of repeating radial passages are in fluid communication with the axial passage that extends through the length of the firearm handguard member. The plurality of repeating radial passages include, for example, a repeating pattern of circular-shaped passages, elongated first oval-shaped passages and elongated second oval-shaped passages that are greater in length than the elongated, first oval-shaped passages.

In some implementations, the second length portion of the length of the firearm handguard member includes the plurality of radial passages of the firearm handguard member.

In some instances, the outer side surface of the firearm handguard member defines an implement mounting rail member.

In some examples, a "the 12 o'clock position" of the outer side surface of the firearm handguard member includes the implement mounting rail member.

In some implementations, the proximal end surface of the firearm handguard member defines a keyed geometry that mates with a corresponding keyed geometry formed by the receiver of the firearm. In some implementations, the firearm handguard assembly further comprises one or more supplementary implement mounting rail members attached to the outer surface of the firearm handguard member.

In some instances, the one or more supplementary implement mounting rail members is/are arranged upon one or more of a 3 o'clock position, a 6 o'clock position and a 9 o'clock position of the outer surface of the firearm handguard member.

In some examples, each of the plurality of radial passages of the locking sleeve member and the plurality of radial passages of the firearm handguard member are defined by a threaded surface portion that correspond to and is threadingly-connected to an outer threaded surface of each fastener of the plurality of fasteners for securing the firearm handguard member to both of the barrel nut member and the locking sleeve member.

Another aspect of the disclosure provides a method for assembling a firearm handguard assembly upon a firearm including a receiver and a barrel that extends from the receiver. The method includes the steps of: connecting a barrel nut member of the firearm handguard assembly to the receiver of the firearm; connecting a locking sleeve member of the firearm handguard assembly to the barrel nut member; connecting a firearm handguard member of the firearm handguard assembly to the barrel nut member and the locking sleeve member; and joining the firearm handguard member to the locking sleeve member and the barrel nut member with a plurality of fasteners.

In some examples, the connecting the barrel nut member to the receiver of the firearm includes the steps of: axially aligning an axial passage of the barrel nut member with the barrel of the firearm; arranging the barrel within the axial passage of the barrel nut member; guiding the barrel nut member along the barrel of the firearm toward the receiver; and threadingly-engaging a threaded surface portion of the barrel nut member with a threaded surface of the receiver.

In some implementations, the connecting the locking sleeve member to the barrel nut member includes the steps of: axially-aligning an axial passage of the locking sleeve member with the barrel of the firearm; arranging the barrel within the axial passage of the locking sleeve member; guiding the locking sleeve member along the barrel of the firearm toward the receiver; and arranging a portion of the locking sleeve member within an axial passage formed by the barrel nut member.

In some instances, the arranging the portion of the locking sleeve member within the axial passage formed by the barrel nut member includes the steps of: arranging a substantially tube-shaped body portion of the locking sleeve member within the axial passage of the barrel nut member until a ledge surface of a substantially circumferential lip portion extending away from the substantially tube-shaped body portion of the locking sleeve member is disposed adjacent a distal end surface of the barrel nut member.

In some examples, after the arranging the portion of the locking sleeve member within the axial passage formed by the barrel nut member step, further comprising the steps of: aligning a plurality of radial fastener passages formed by the locking sleeve member with a plurality of radial fastener passages formed by the barrel nut member; and extending the plurality of fasteners of the firearm handguard assembly through the aligned plurality of radial fastener passages formed by the locking sleeve member and the plurality of radial fastener passages formed by the barrel nut member for conducting the step of joining the firearm handguard member to the locking sleeve member and the barrel nut member with a plurality of fasteners.

In some implementations, the axially-aligning step further comprises the step of: axially aligning a radial passage formed along an entire length of the locking sleeve member with a 12 o'clock position of the firearm.

In some instances, the connecting the firearm handguard member to the locking sleeve member to the barrel nut member includes the steps of: axially-aligning an axial passage of the firearm handguard member with the barrel of the firearm; arranging the barrel within the axial passage of the firearm handguard member; guiding the firearm handguard member along the barrel of the firearm toward the receiver; and arranging the locking sleeve member and the barrel nut member within the axial passage formed by the firearm handguard member.

In some examples, the arranging the locking sleeve member and the barrel nut member within the axial passage formed by the firearm handguard member continues until a keyed geometry of the firearm handguard member mates with a corresponding keyed geometry formed by the receiver of the firearm.

In some implementations, after the arranging the locking sleeve member and the barrel nut member within the axial passage formed by the firearm handguard member step, further comprising the step of: aligning a plurality of radial fastener passages of the firearm handguard member with a plurality of radial fastener passages formed by the locking sleeve member and a plurality of radial fastener passages formed by the barrel nut member; and extending the plurality of fasteners of the firearm handguard assembly through the aligned plurality of radial fastener passages of the firearm handguard member, the plurality of radial fastener passages formed by the locking sleeve member and the plurality of radial fastener passages formed by the barrel nut member for conducting the step of joining the firearm handguard member to the locking sleeve member and the barrel nut member with a plurality of fasteners.

In some instances, prior to the connecting the barrel nut member of the firearm handguard assembly to the receiver of the firearm step, further comprising the steps of: arranging a shim ring between the barrel lip and barrel nut member; aligning a plurality of radial fastener passages of the firearm handguard member with a plurality of radial fastener passages formed by the locking sleeve member and a plurality of radial fastener passages formed by the barrel nut member; and extending the plurality of fasteners of the firearm handguard assembly through the aligned plurality of radial fastener passages of the firearm handguard member, the plurality of radial fastener passages formed by the locking sleeve member and the plurality of radial fastener passages formed by the barrel nut member for conducting the step of joining the firearm handguard member to the locking sleeve member and the barrel nut member with a plurality of fasteners.

In yet another aspect of the disclosure provides a method for assembling a firearm handguard assembly. The method includes the steps of: connecting a locking sleeve member of the firearm handguard assembly to a barrel nut member of the firearm handguard assembly; connecting a firearm handguard member of the firearm handguard assembly to the barrel nut member and the locking sleeve member; and extending a plurality of fasteners through each of the firearm handguard member, the locking sleeve member and the barrel nut member for joining the firearm handguard member to the locking sleeve member and the barrel nut member.

In some examples, prior to the connecting the locking sleeve member of the firearm handguard assembly to the barrel nut member of the firearm handguard assembly step, further comprising the step of: connecting the barrel nut member of the firearm handguard assembly to a receiver of the firearm.

One aspect of the disclosure provides a component of a firearm handguard assembly. The component of the firearm handguard assembly includes a barrel nut member. The barrel nut member is defined by a substantially tube-shaped body having a distal end surface, a proximal end surface, an inner axial passage surface and an outer side surface. The inner axial passage surface defines an axial passage that extends through a length of the barrel nut member between the distal end surface and the proximal end surface. A plurality of radial passages extend through a thickness of the substantially tube-shaped body. The thickness extends between the inner axial passage surface and the outer side surface. The plurality of radial passages are in fluid communication with the axial passage. The axial passage of the barrel nut member is permitted by a distal axial opening formed by the distal end surface of the substantially tube-shaped body and a proximal axial opening formed by the proximal end surface of the substantially tube-shaped body.

In some examples, the plurality of radial passages of the barrel nut member includes a first radial passage, a second radial passage, a third radial passage and a fourth radial passage.

In some implementations, the first radial passage and the second radial passage are arranged in an opposing relationship to thereby define the substantially tube-shaped body to include a first substantially circumferential passage. The third radial passage and the fourth radial passage are arranged in an opposing relationship to thereby define the substantially tube-shaped body to include a second substantially circumferential passage. The first substantially circumferential passage and the second substantially circumferential passage are spaced apart by a distance.

In some instances, each radial passage of the plurality of radial passages of the barrel nut member defines an arcuate-shaped dimension that extends along slightly less than about 180° of the substantially tube-shaped body.

In some examples, the inner axial passage surface of the barrel nut member includes a threaded surface portion.

In some implementations, the threaded surface portion corresponds to and is threadingly-connectable with a threaded surface of a receiver of the firearm.

In some instances, the length of the barrel nut member includes a first length portion extending away from the distal end surface and a second length portion extending away from the proximal end surface.

In some examples, the first length portion of the barrel nut member includes the plurality of radial passages. The second length portion of the barrel nut member includes the threaded surface portion.

Another aspect of the disclosure provides a component of a firearm handguard assembly. The component of the firearm handguard includes a locking sleeve member. The locking sleeve member includes a substantially circumferential lip portion and a substantially tube-shaped body portion. The substantially tube-shaped body portion is connected to the substantially circumferential lip portion. The substantially circumferential lip portion and the substantially tube-shaped body portion form a radial passage that extends along an entire length locking sleeve member. A plurality of radial passages extend through a thickness of the substantially tube-shaped body portion.

In some examples, the plurality of radial passages include six radial passages defined by: a first pair of radial passages defined by a first radial passage and a second radial passage, a second pair of radial passages defined by a third radial passage and a fourth radial passage, and a third pair of radial passages defined by a fifth radial passage and a sixth radial passage. Each passage of the first, second and third pairs of passages of the locking sleeve member are spaced apart by a distance.

In some implementations, each of the first pair of radial passages and the third pair of radial passages are offset by approximately 90° from the second pair of radial passages.

In some instances, the first pair of radial passages are arranged at a 3 o'clock position of the locking sleeve member. The second pair of radial passages are arranged at a 6 o'clock position of the locking sleeve member. The third pair of radial passages are arranged at a 9 o'clock position of the locking sleeve member.

In some examples, the radial passage is arranged at a 12 o'clock position of the locking sleeve member.

In some implementations, the substantially circumferential lip portion defines a distal end surface of the locking sleeve member. The substantially tube-shaped body portion defines a proximal end surface of the locking sleeve member.

In some instances, both of the substantially circumferential lip portion and the substantially tube-shaped body portion define an inner axial passage surface. Both of the substantially circumferential lip portion and the substantially tube-shaped body portion define an outer side surface. The substantially circumferential lip portion includes a ledge surface that connects a first portion of the outer side surface that is defined by the substantially circumferential lip portion to a second portion of the outer side surface that is defined by the substantially tube-shaped body portion. The ledge surface demarcates the substantially circumferential lip portion from the substantially tube-shaped body portion.

In some examples, the inner axial passage surface of the locking sleeve member defines an axial passage that extends through the length of the locking sleeve member between the distal end surface of the locking sleeve member and the proximal end surface of the locking sleeve member.

In some implementations, access to the axial passage of the locking sleeve member is permitted by a distal axial opening formed by the distal end surface of the substantially circumferential lip portion and a proximal axial opening formed by the proximal end surface of the substantially tube-shaped body portion.

In some instances, a plurality of the radial passages of the locking sleeve member extend through the thickness of the locking sleeve member such that the plurality of radial passages are in fluid communication with the axial passage that extends through the length of the locking sleeve member.

DETAILED DESCRIPTION

The figures illustrate an exemplary implementation of firearm handguard components, an assembly and method for forming the same. Based on the foregoing, it is to be generally understood that the nomenclature used herein is simply for convenience and the terms used to describe the invention should be given the broadest meaning by one of ordinary skill in the art.

Figure 1B:
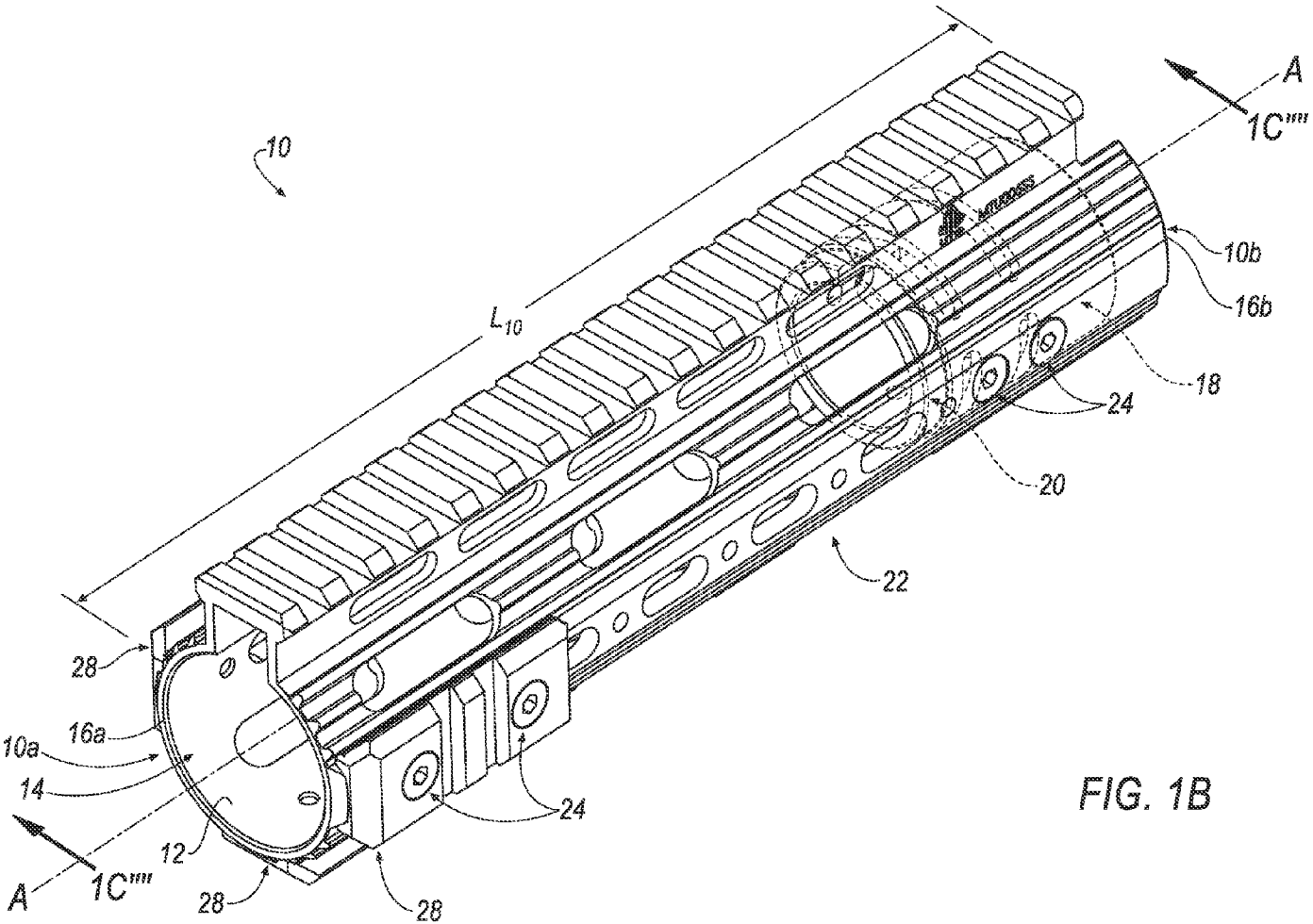
FIG. 1B is an assembled view of the firearm handguard assembly of FIG. 1A.

FIG. 1A-1B illustrate an exemplary firearm handguard assembly, which is shown generally at 10. The firearm handguard assembly 10 includes a distal end surface 10*a* and a proximal end surface 10*b*. The firearm handguard assembly 10 includes an inner axial passage surface 12 that defines an axial passage 14 that extends through a length, $L_{10}$ (see, e.g., FIG. 1B), of the firearm handguard assembly 10 along a central axis, A-A, between the distal end surface 10*a* of the firearm handguard assembly 10 and the proximal end surface 10*b* of the firearm handguard assembly 10. Access to the axial passage 14 is permitted by a distal axial opening 16*a* formed by the distal end surface 10*a* of the firearm handguard assembly 10 and a proximal axial opening 16*b* formed by the proximal end surface 10*b* of the firearm handguard assembly 10.

Figure 6A:
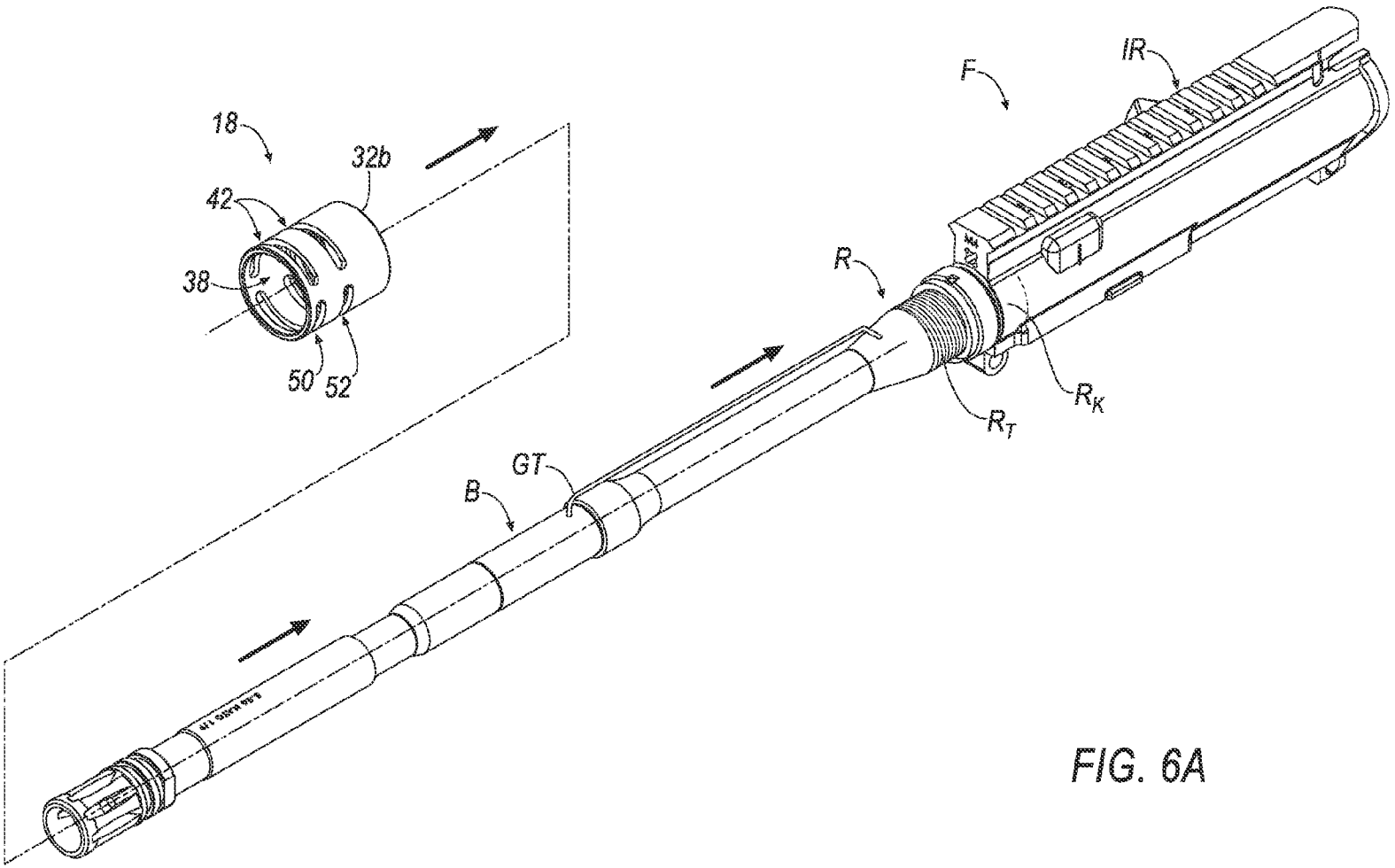
FIGS. 6A-6G are perspective views of an exemplary firearm and a method for joining the firearm handguard assembly of FIGS. 1A-1B to the firearm.
Figure 6B:
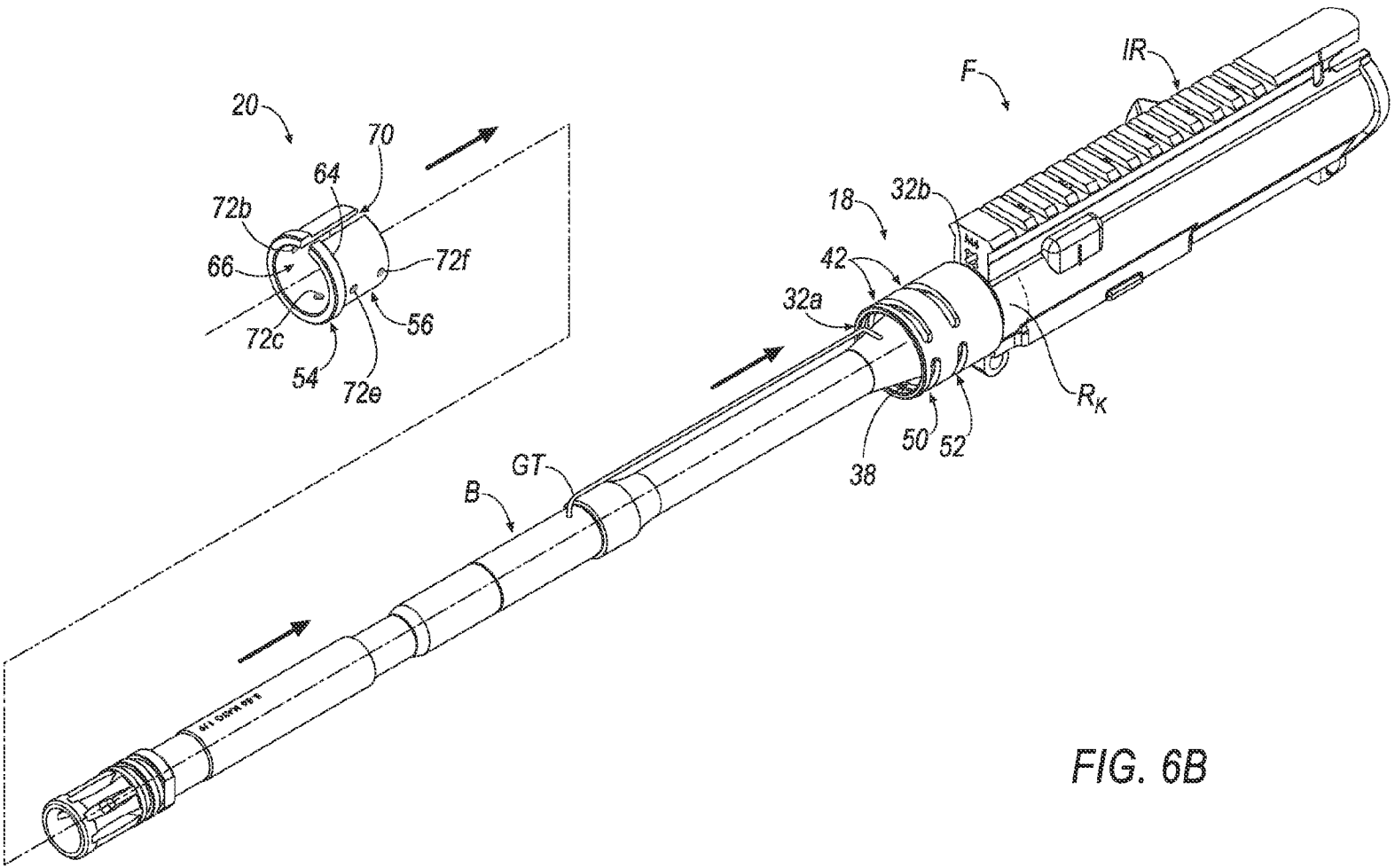
Figure 6C:
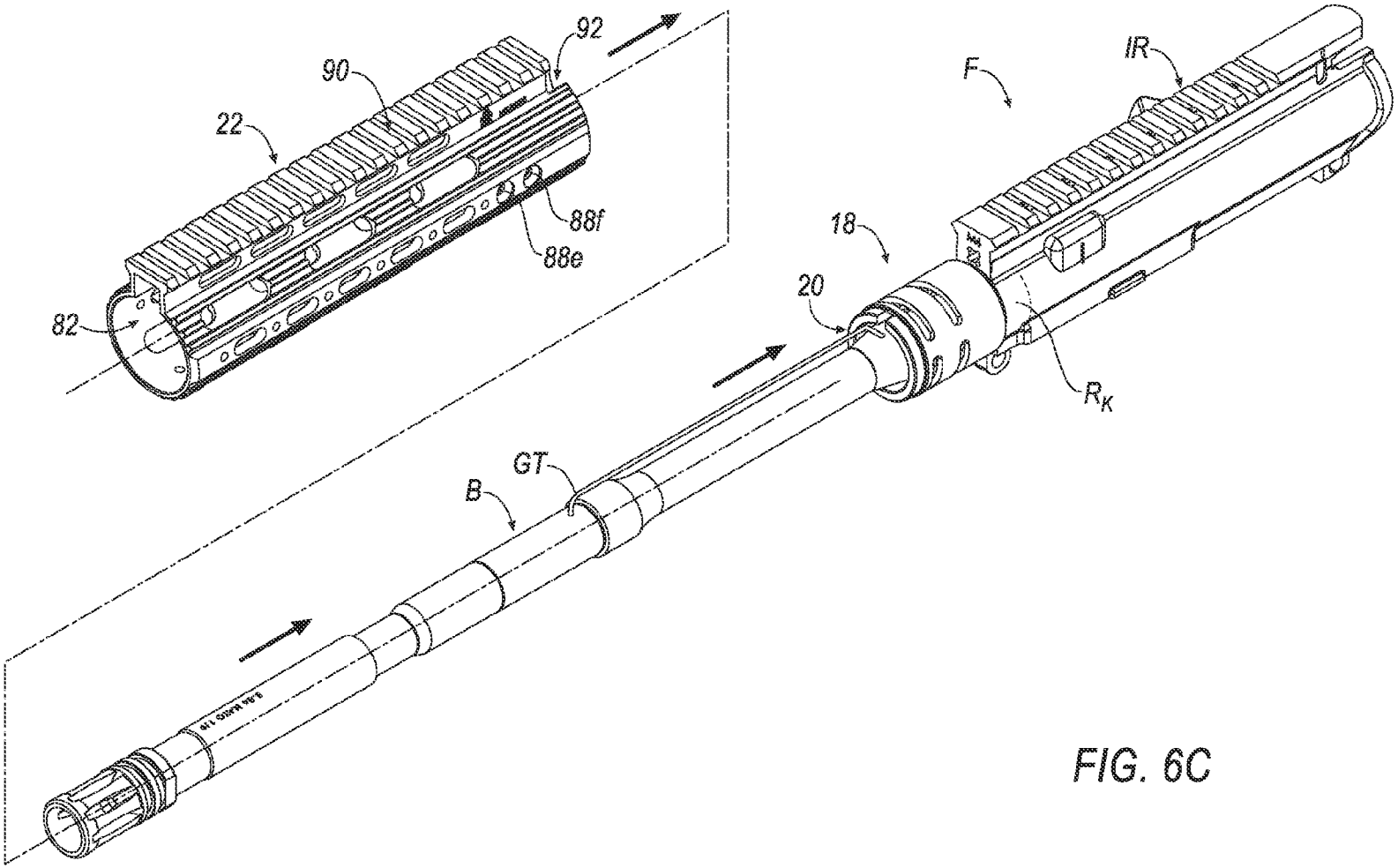
Figure 6D:
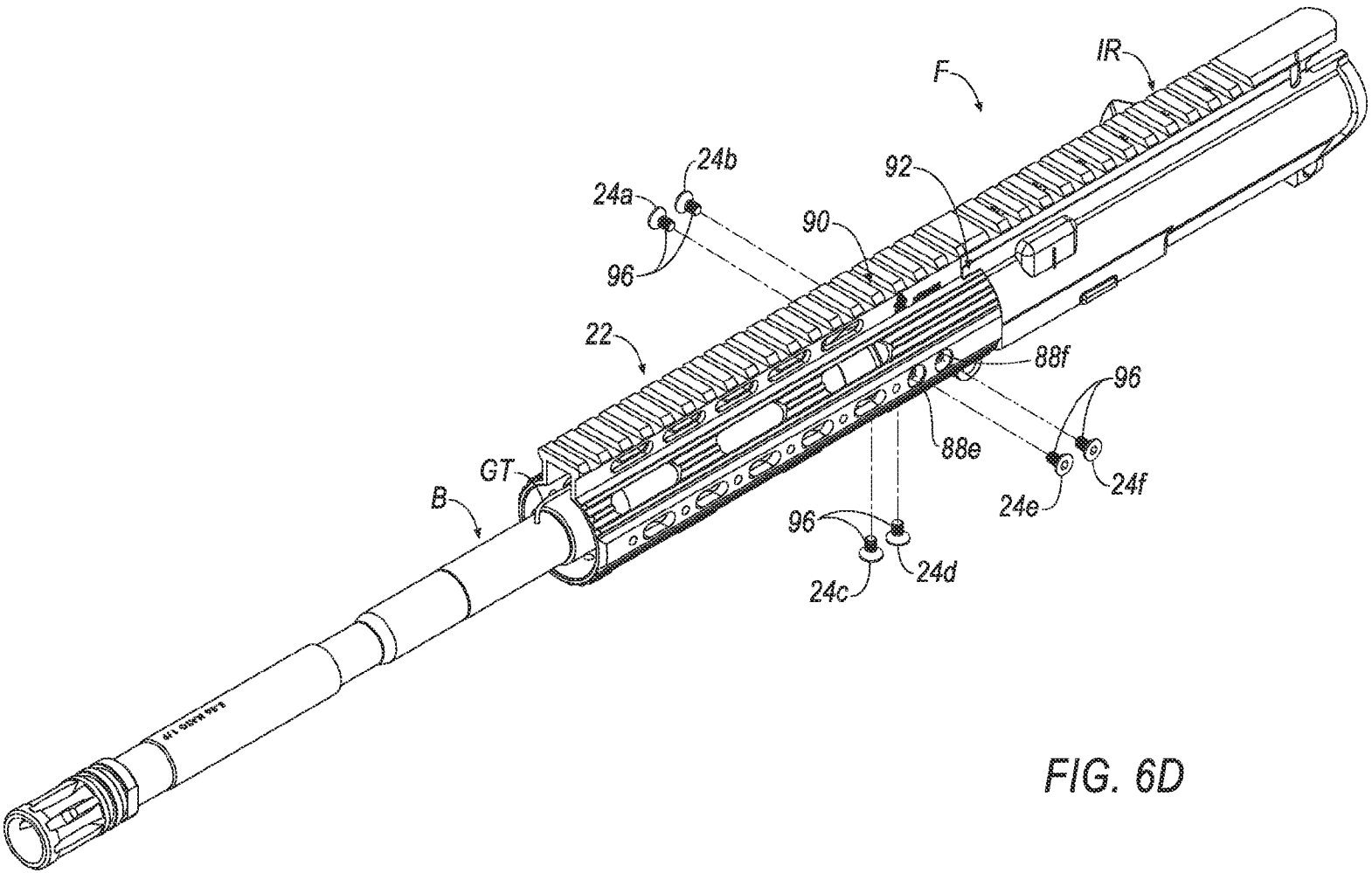
Figure 6E:
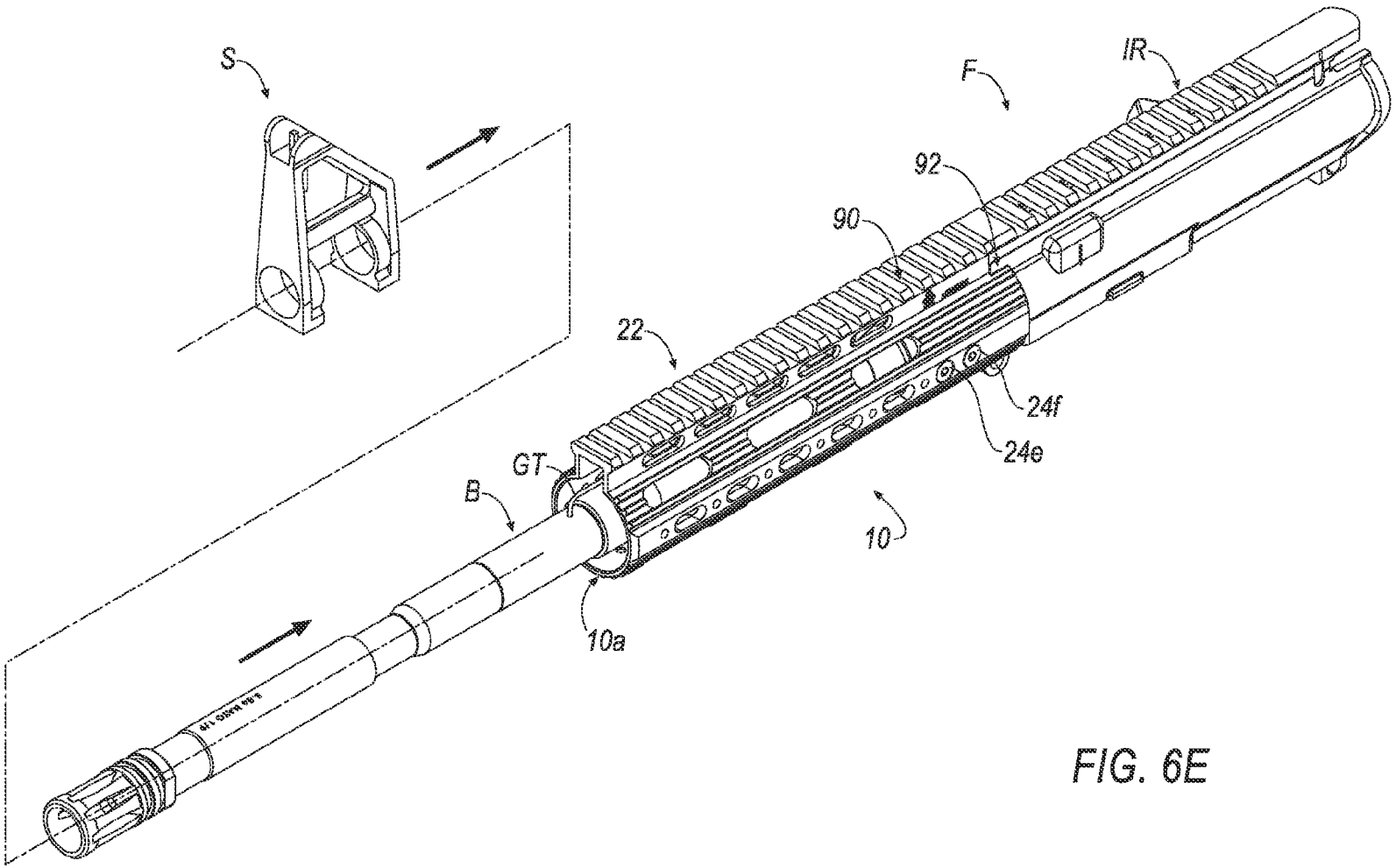

Referring to FIG. 6E, an implementation of the firearm handguard assembly 10 is shown attached to a firearm, F. As seen in FIG. 6A, the firearm, F, includes at least, for example, a receiver, R, and a barrel, B. The barrel, B, extends axially away from the receiver, R.

When the firearm handguard assembly 10 is attached to the firearm, F, the barrel, B, extends through the axial passage 14 of the firearm handguard assembly 10 in a spaced-apart relationship with respect to a portion of the inner axial passage surface 12 of the firearm handguard assembly 10 (defined by at least, e.g., a firearm handguard member 22 of the firearm handguard assembly 10). Because the barrel, B, is arranged in a spaced-apart relationship with respect to a portion of the inner axial passage surface 12 of the firearm handguard assembly 10, any heat generated by the barrel, B, is permitted to escape to the surrounding atmosphere while also preventing a user from directly touching the barrel, B, which may be at a temperature higher than ambient temperature after the firearm, F, is fired. As a result of the spaced-apart relationship of the barrel, B, of the firearm, F, with respect to a portion of the inner axial passage surface 12 of the firearm handguard assembly 10, the firearm handguard assembly 10 may be referred to as a "free float" firearm handguard assembly 10 due to at least a portion (e.g., the firearm handguard member 22) of the firearm handguard assembly 10 being arranged in a "floating" relationship with respect to the barrel, B, of the firearm, F.

Referring to FIG. 1A, the firearm handguard assembly 10 generally includes a plurality of components 18-24. In an embodiment, the components 18-24 of the firearm handguard assembly 10 may include: a barrel nut member 18 (see also, e.g., FIGS. 2A-2F), a locking sleeve member 20 (see also, e.g., FIGS. 3A-3F), a firearm handguard member 22 (see also, e.g., FIGS. 4A-4G) and a plurality of fasteners 24 (see also, e.g., FIGS. 5A-5D).

Referring also to FIG. 1A, the firearm handguard assembly 10 may also include an optional shim ring 26. Referring to FIGS. 1A and 1B, the firearm handguard assembly 10 may also include one or more optional supplementary implement mounting rail members 28.

Prior to joining the components 18-24 together for forming the firearm handguard assembly 10, one of the components 18-24 may be firstly attached to the firearm, F. As seen in, for example, FIGS. 6A-6B, the barrel nut member 18 may be firstly attached to the receiver, R, of the firearm, F.

Figure 1C:
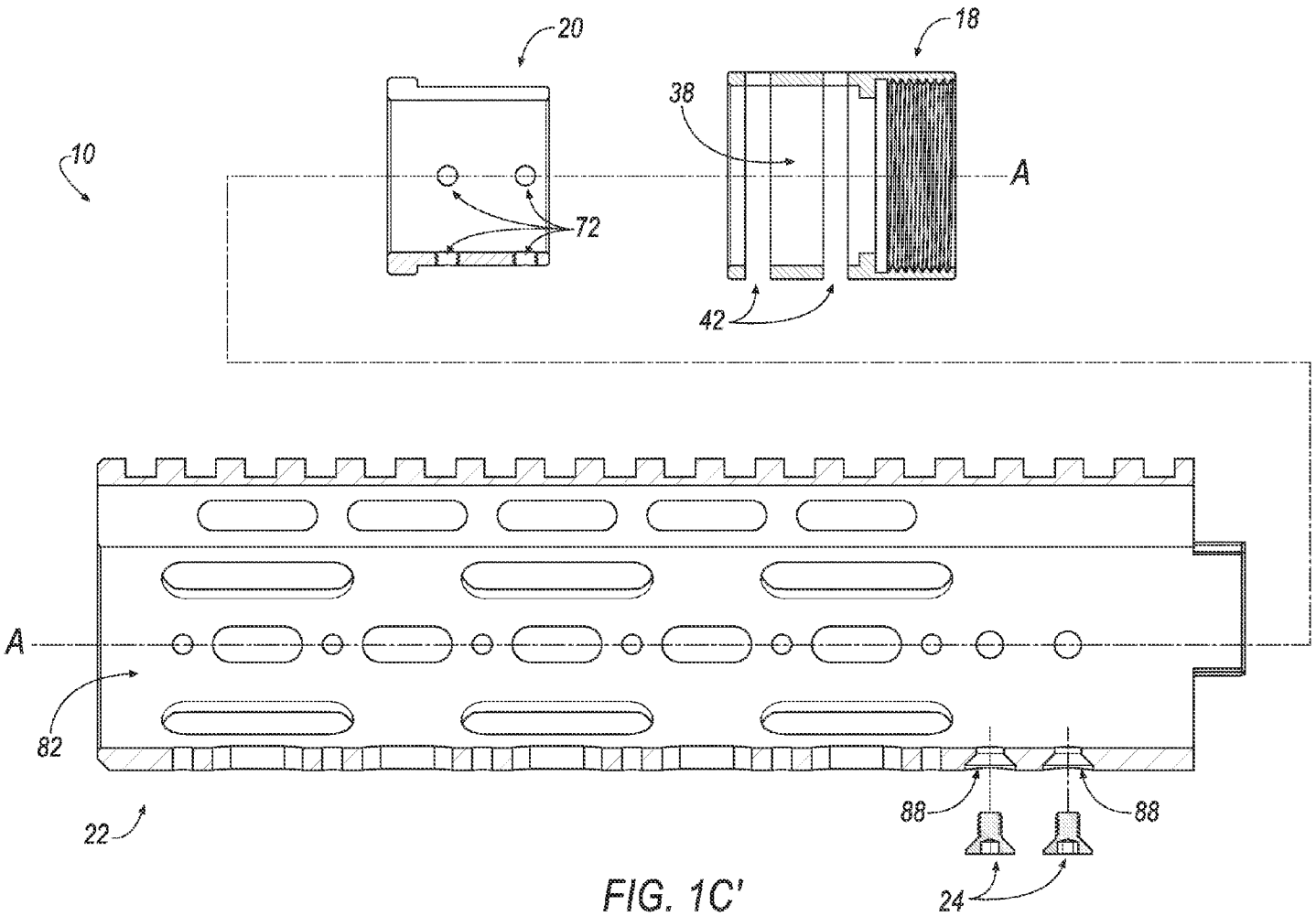
FIG. 1C'-1C"" are side cross-sectional views of the of the firearm handguard assembly according to line 1C'-1C' of FIG. 1A and line 1C'-1C"" of FIG. 1B.
Figure 1C:
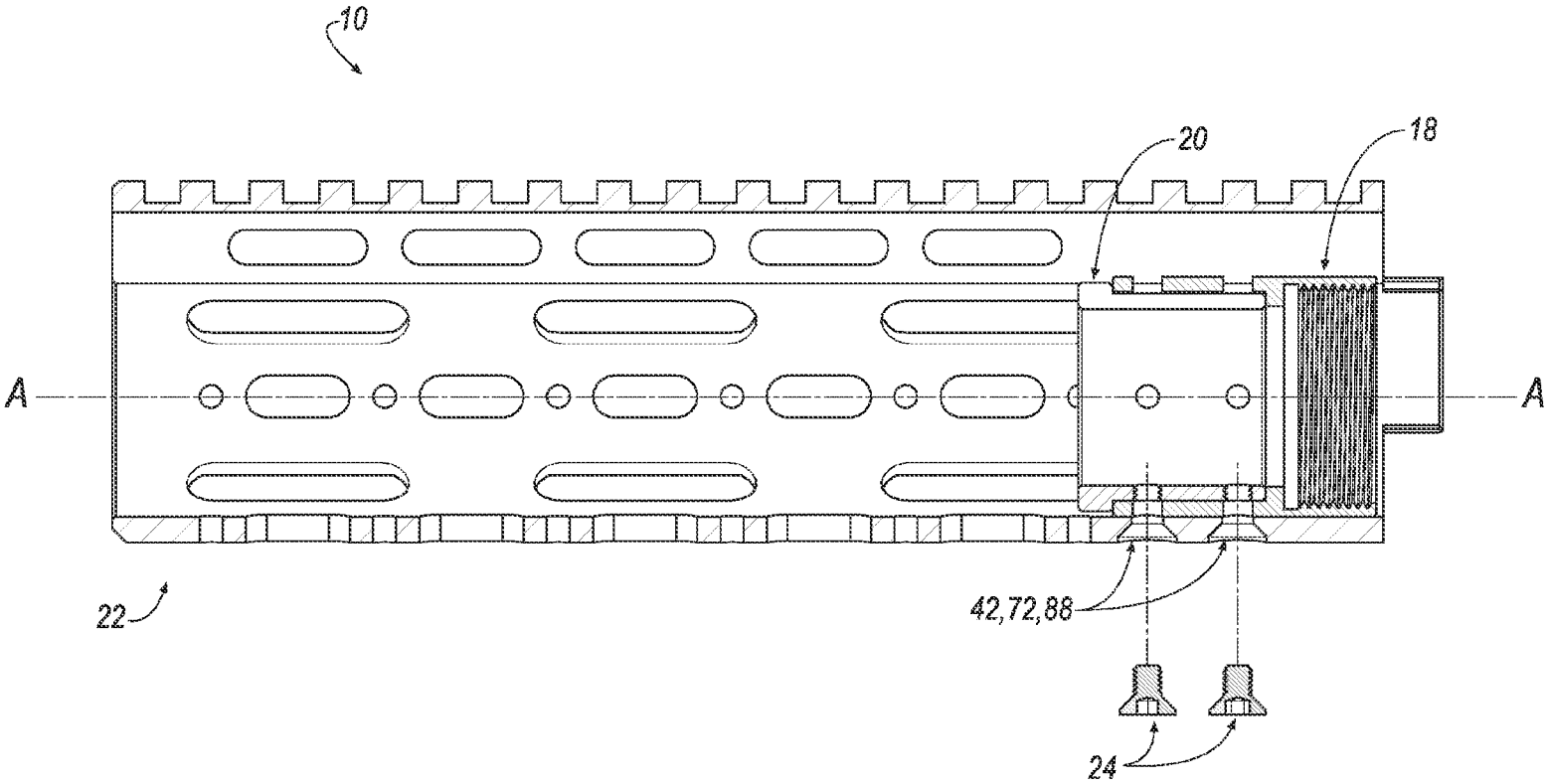

Referring to FIGS. 1C'-1C'''', the components 18-24 of the firearm handguard assembly 10 are joined together for forming the firearm handguard assembly 10. Although some implementations of a method for assembling the firearm handguard assembly 10 may include firstly attaching the barrel nut member 18 of the firearm, F, as described above, the handguard assembly 10 may be assembled in the absence of a firearm, F, as shown and described at FIGS. 1C'-1C'''', and, as a result, it should be understood by the skilled artisan that the firearm, F, itself may not be considered to be a component of the firearm handguard assembly 10 nor is the firearm, F, required in order to assemble the firearm handguard assembly 10.

Referring initially to FIGS. 1C'-1C", a method for assembling the firearm handguard assembly 10 is described. Firstly, the locking sleeve member 20 may be disposed within an axial passage 38 of the barrel nut member 18. Referring to FIG. 1C", upon disposing the locking sleeve member 20 within the axial passage 38 of the barrel nut member 18, a plurality of radial passages 72 of the locking sleeve member 20 are aligned with a plurality of radial passages 42 of the barrel nut member 18.

Referring to FIGS. 1C"-1C'''', the firearm handguard member 22 is arranged about the barrel nut member 18 and the locking sleeve member 20 such that the barrel nut member 18 and the locking sleeve member 20 are arranged within an axial passage 82 of the firearm handguard member 22. Referring to FIG. 1C''', upon arranging the firearm handguard member 22 about the locking sleeve member 20 and the barrel nut member 18, a plurality of radial passages 88 of the firearm handguard member 22 are aligned with the plurality of radial passages 72 of the locking sleeve member 20 and the plurality of radial passages 42 of the barrel nut member 18.

Referring to FIGS. 1C''', the plurality of fasteners 24 may then be aligned with the aligned plurality of radial passages 42, 72, 88 of the barrel nut member 18, the locking sleeve member 20 and the firearm handguard member 22. Referring to FIG. 1C'''', the plurality of fasteners 24 may be inserted: (1) firstly through the plurality of radial passages 88 of the firearm handguard member 22, then (2) secondly through the plurality of radial passages 42 of the barrel nut member 18 and then (3) thirdly through the plurality of radial passages 72 of the locking sleeve member 20 for joining the firearm handguard member 22 to the barrel nut member 18 and the locking sleeve member 20. Once the plurality of fasteners 24 join the firearm handguard member 22 to the barrel nut member 18 and the locking sleeve member 20, the firearm handguard assembly 10 may be said to be assembled.

Referring to FIGS. 2A-2F, the barrel nut member 18 is shown according to an embodiment. The barrel nut member 18 is defined by a substantially tube-shaped body 30. The substantially tube-shaped body 30 is defined by a distal end surface 32*a*, a proximal end surface 32*b*, an inner axial passage surface 34 and an outer side surface 36.

Figure 2A:
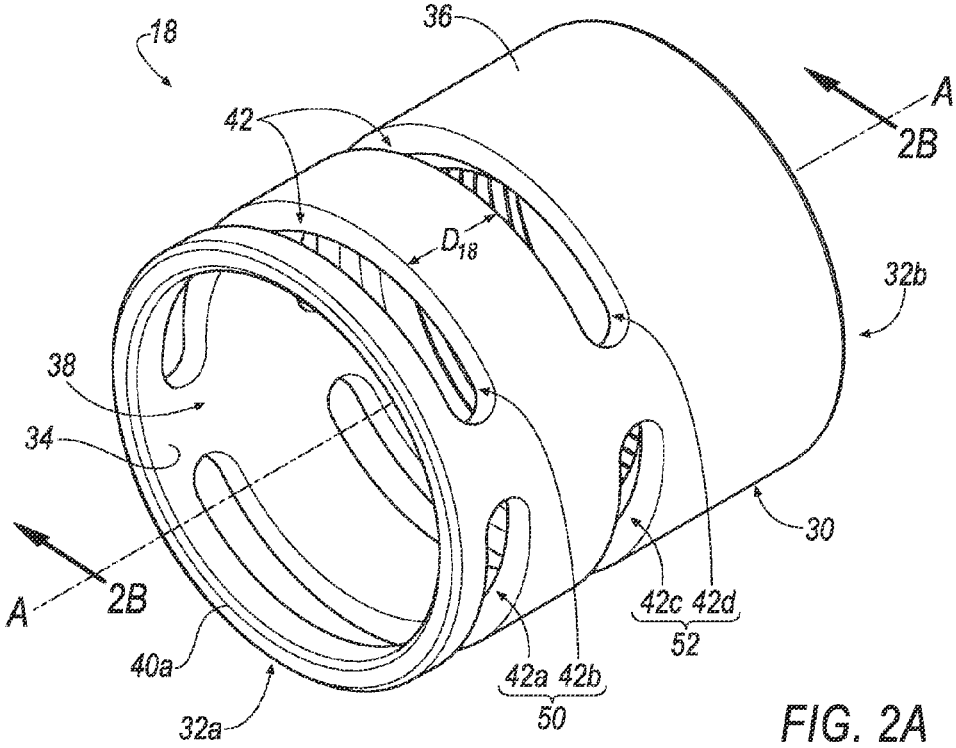
FIGS. 2A-2F are views of an exemplary barrel nut member of the firearm handguard assembly of FIGS. 1A-1B.
Figure 2B:
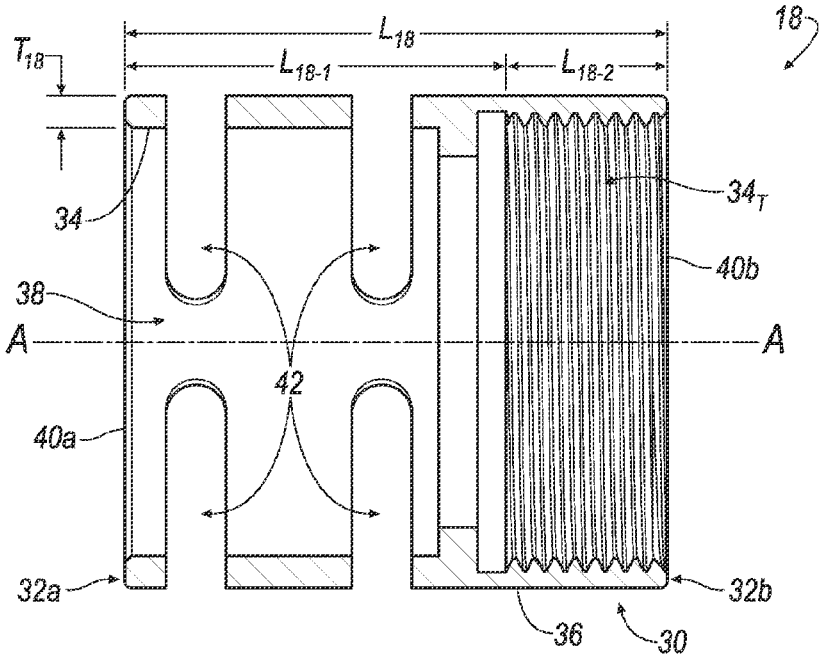
Figure 2C:
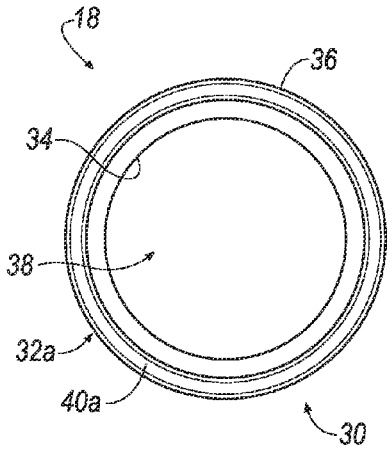
Figure 2D:
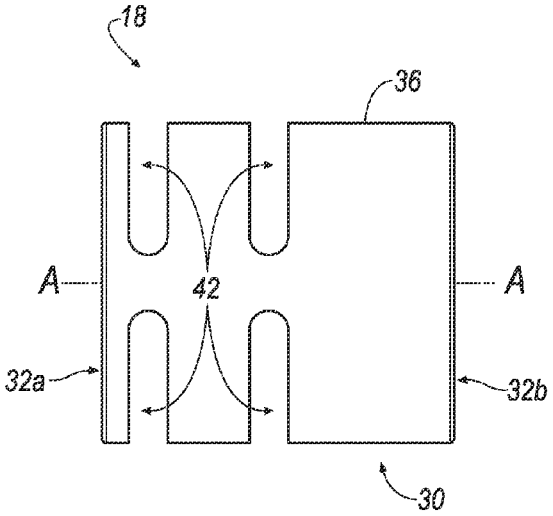
Figure 2E:
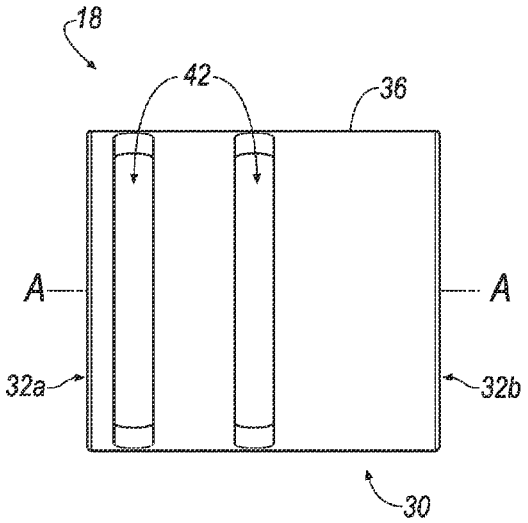
Figure 2F:
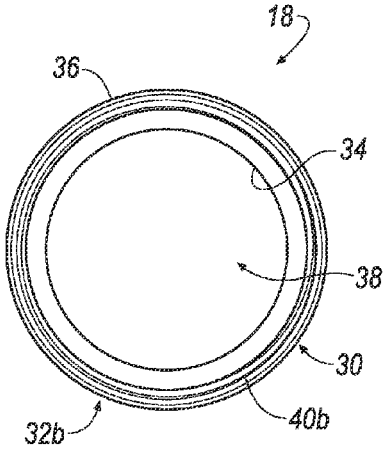

Referring to FIG. 2B, the substantially tube-shaped body 30 may define the barrel nut member 18 to include a length, $L_{18}$. The length, $L_{18}$, of the barrel nut member 18 may include a first length portion, $L_{18\text{-}1}$, extending away from the distal end surface 32*a* of the substantially tube-shaped body 30 and a second length portion, $L_{18-2}$, extending away from the proximal end surface 32*b* of the substantially tube-shaped body 30. The substantially tube-shaped body 30 may also define a thickness, $T_{18}$, of the barrel nut member 18 extending between the inner axial passage surface 34 and the outer side surface 36.

The inner axial passage surface 34 defines an axial passage 38 that extends through the length, $L_{18}$, of the barrel nut member 18 along a central axis, A-A, between the distal end surface 32*a* of the substantially tube-shaped body 30 and the proximal end surface 32*b* of the substantially tube-shaped body 30. Access to the axial passage 38 of the barrel nut member 18 is permitted by a distal axial opening 40*a* formed by the distal end surface 32*a* of the substantially tube-shaped body 30 and a proximal axial opening 40*b* formed by the proximal end surface 32*b* of the substantially tube-shaped body 30.

Referring to FIG. 2B, the first length portion, $L_{18-1}$, of the barrel nut member 18 may include a plurality of radial passages 42. The plurality of radial passages 42 may extend through the thickness, $T_{18}$, of the barrel nut member 18 such that the plurality of radial passages 42 are in fluid communication with the axial passage 38 that extends through the length, $L_{18}$, of the barrel nut member 18.

In an implementation, as seen in FIG. 2A, the plurality of radial passages 42 may include a first radial passage 42*a*, a second radial passage 42*b*, a third radial passage 42*c* and a fourth radial passage 42*d*. Each radial passage 42*a*-42*d* of the plurality of radial passages 42 generally define an arcuate-shaped dimension that extends along slightly less than about 180° of the substantially tube-shaped body 30.

The first arcuate-shaped radial passage 42*a* and the second arcuate-shaped radial passage 42*b* may be arranged in an opposing relationship to thereby define the substantially tube-shaped body 30 to include a first substantially circumferential passage 50. The third arcuate-shaped radial passage 42*c* and the fourth arcuate-shaped radial passage 42*d* may be arranged in an opposing relationship to thereby define the substantially tube-shaped body 30 to include a second substantially circumferential passage 52. The first and second substantially circumferential passages 50, 52 may be spaced apart by a distance, $D_{18}$.

Referring to FIG. 2B, the inner axial passage surface 34 of the second length portion, $L_{18-2}$, of the barrel nut member 18 may include a threaded surface portion $\mathbf{34}_T$. As will be described in the following disclosure at FIGS. 6A-6B, the threaded surface portion $\mathbf{34}_T$ of the inner axial passage surface 34 corresponds to and is threadingly-connected to a threaded surface, $R_T$, of the receiver, R, of the firearm, F.

Referring to FIGS. 3A-3F, the locking sleeve member 20 is shown according to an embodiment. The locking sleeve member 20 is defined by a substantially circumferential lip portion 54 and a substantially tube-shaped body portion 56 connected to the substantially circumferential lip portion 54. The substantially circumferential lip portion 54 defines a distal end surface 58*a* of the locking sleeve member 20. The substantially tube-shaped body portion 56 defines a proximal end surface 58*b* of the locking sleeve member 20.

Both of the substantially circumferential lip portion 54 and the substantially tube-shaped body portion 56 define an inner axial passage surface 60 of the locking sleeve member 20. Both of the substantially circumferential lip portion 54 and the substantially tube-shaped body portion 56 define an outer side surface 62 of the locking sleeve member 20.

Figure 3A:
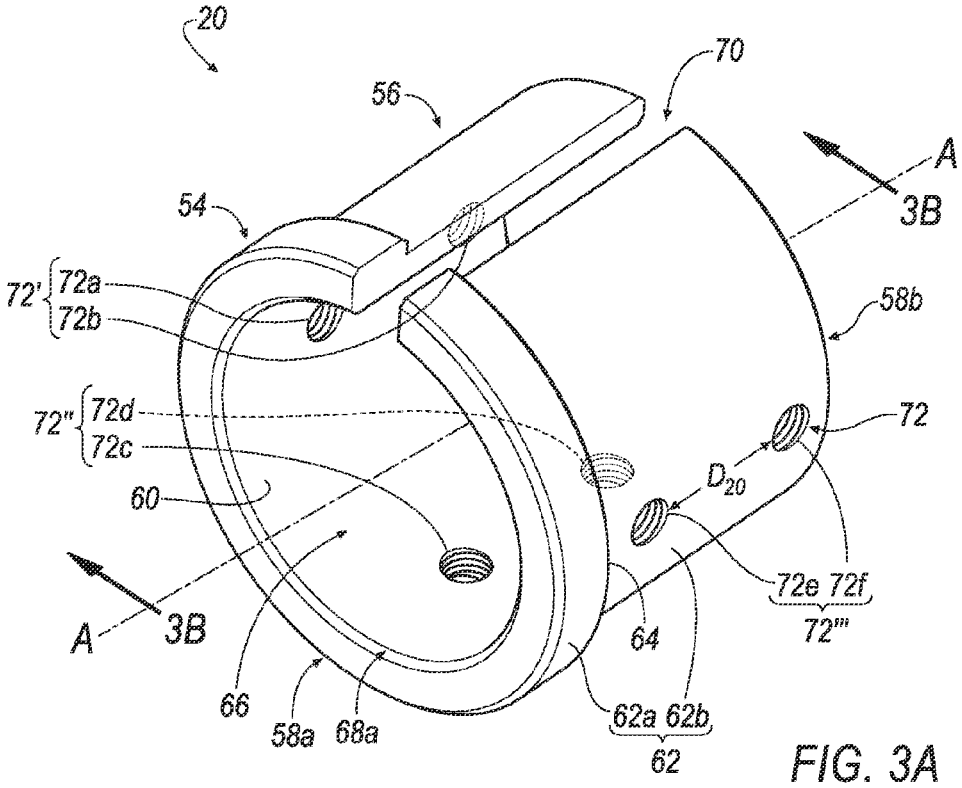
FIGS. 3A-3F are views of an exemplary locking sleeve member of the firearm handguard assembly of FIGS. 1A-1B.
Figure 3B:
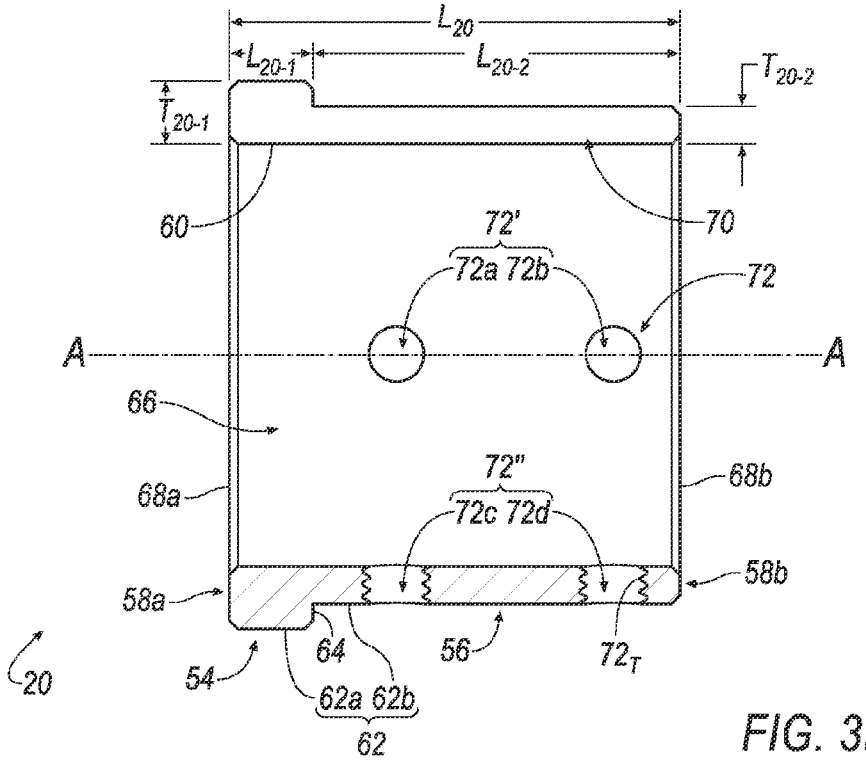
Figure 3C:
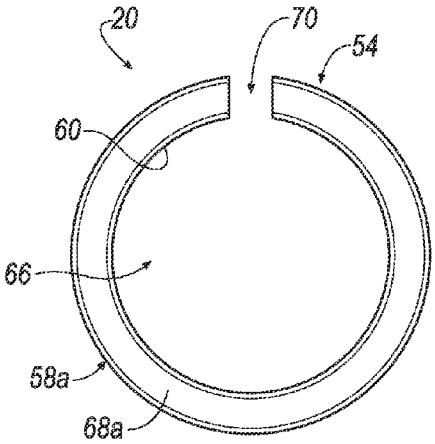
Figure 3D:
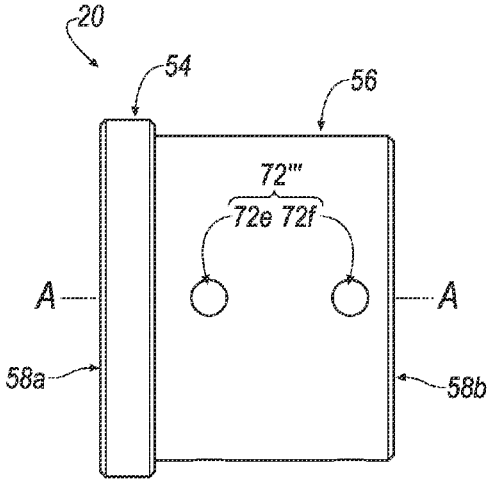
Figure 3E:
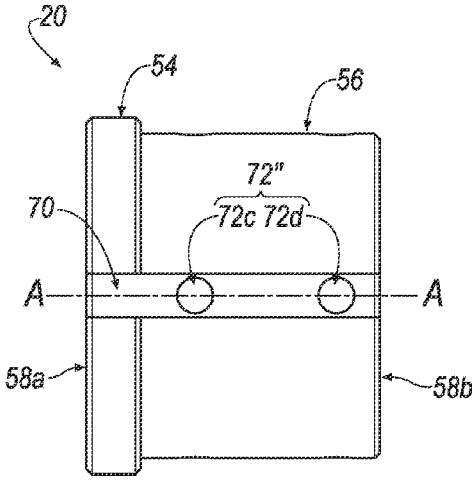
Figure 3F:
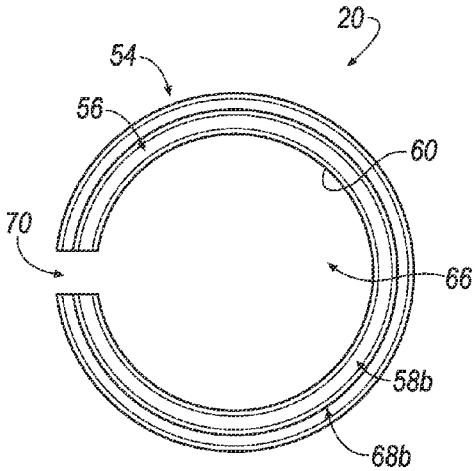

Referring to FIGS. 3A-3B, the substantially circumferential lip portion 54 may include a ledge surface 64 that connects a first portion 62*a* of the outer side surface 62 defined by the substantially circumferential lip portion 54 to a second portion 62*b* of the outer side surface 62 defined by the substantially tube-shaped body portion 56. The ledge surface 64 generally demarcates the substantially circumferential lip portion 54 from the substantially tube-shaped body portion 56.

Referring to FIG. 3B, the locking sleeve member 20 includes a length, $L_{20}$. The substantially circumferential lip portion 54 of the locking sleeve member 20 may define a first length portion, $L_{20-1}$, extending away from the distal end surface 58*a* of the locking sleeve member 20. The substantially tube-shaped body portion 56 of the locking sleeve member 20 may define a second length portion, $L_{20-2}$, extending away from the proximal end surface 58*b* of the locking sleeve member 20.

With continued reference to FIG. 3B, the substantially circumferential lip portion 54 may also define a first thickness, $T_{20-1}$, of the locking sleeve member 20 extending between the inner axial passage surface 60 and the outer side surface 62. The substantially tube-shaped body portion 56 may also define a second thickness, $T_{20-2}$, of the locking sleeve member 20 extending between the inner axial passage surface 60 and the outer side surface 62. The first thickness, $T_{20-1}$, of the locking sleeve member 20 is greater than the second thickness, $T_{20-2}$, of the locking sleeve member 20.

The inner axial passage surface 60 defines an axial passage 66 that extends through the length, $L_{20}$, of the locking sleeve member 20 along a central axis, A-A, between the distal end surface 58*a* of the locking sleeve member 20 and the proximal end surface 58*b* of the locking sleeve member 20. Access to the axial passage 66 of the locking sleeve member 20 is permitted by a distal axial opening 68*a* formed by the distal end surface 58*a* of the substantially circumferential lip portion 54 and a proximal axial opening 68*b* formed by the proximal end surface 58*b* of the substantially tube-shaped body portion 56.

Referring to FIGS. 3A-3B, the length, $L_{20}$, of the locking sleeve member 20 forms a radial passage 70. The radial passage 70 extends along the entire length of the substantially circumferential lip portion 54 defined by the first length portion, $L_{20-1}$, of the length, $L_{20}$, of the locking sleeve member 20 and the substantially tube-shaped body portion 56 defined by the second length portion, $L_{20-2}$, of the length, $L_{20}$, of the locking sleeve member 20. Functionally, the radial passage 70 permits the locking sleeve member 20 to expand when the plurality of fasteners 24 are utilized to join/lock the locking sleeve member 20 to the handguard member 22. Additionally, the radial passage 70 may serve as a visual indicator to a user for aligning the radial passage 70 at a "12 o'clock" position with respect to the firearm, F, such that a plurality of radial passages 72 of the locking sleeve member 20 may be aligned with a plurality of passages 88 of the handguard member 22 in order to permit the plurality of fasteners to pass through the plurality of passages 22 of the locking sleeve member 20 and the handguard member 22.

As seen in FIGS. 3A-3B, the second length portion, $L_{20-2}$, of the length, $L_{20}$, of the locking sleeve member 20 may include a plurality of radial passages 72. The plurality of radial passages 72 may extend through the second thickness, $T_{20-2}$, of the locking sleeve member 20 such that the plurality of radial passages 72 are in fluid communication with the axial passage 66 that extends through the length, $L_{20}$, of the locking sleeve member 20.

Referring to FIG. 3A, in an implementation, the plurality of radial passages 72 may include six radial passages 72*a*-72*f* defined by: a first pair of radial passages 72' defined by a first radial passage 72*a* and a second radial passage 72*b*, a second pair of radial passages 72" defined by a third radial passage 72*c* and a fourth radial passage 72*d* and a third pair of radial passages 72'" defined by a fifth radial passage 72*e* and a sixth radial passage 72*f*. Each passage 72*a*-72*f* of the pairs of passages 72'-72'" may be spaced apart by a distance, $D_{20}$; the spaced apart distance, $D_{20}$, of each passage 72*a*-72*f* of the pairs of passages 72'-72'" may be approximately equal to the spaced apart distance, $D_{18}$, of the first and second substantially circumferential passages 50, 52 of the barrel nut member 18.

In an implementation, the radial passage 70 that extends along length, $L_{20}$, of the locking sleeve member 20 may be said to be arranged at "the 12 o'clock position" of the locking sleeve member 20. In an implementation, the first pair of radial passages 72' may be said to be arranged at "the 9 o'clock position" of the locking sleeve member 20. In an implementation, the second pair of radial passages 72" may be said to be arranged at "the 6 o'clock position" of the locking sleeve member 20. In an implementation, the third pair of radial passages 72'" may be said to be arranged at "the 3 o'clock position" of the locking sleeve member 20. Accordingly, in an embodiment, each of the radial passage 70 and first, second, third pairs of radial passages 72'-72'" may be offset by approximately about 90°.

As seen in, for example, FIG. 3B, each radial passage 72*a*-72*f* of the plurality of radial passages 72 is defined by a threaded surface portion $\mathbf{72}_T$. As will be described in the following disclosure at FIGS. 6D-6E, the threaded surface portion $\mathbf{72}_T$ corresponds to and is threadingly-connected to the outer threaded surface $\mathbf{96}_T$ of a fastener 24*a*-24*f* of the plurality of fasteners 24 for securing the firearm handguard member 22 to both of the barrel nut member 18 and the locking sleeve member 20.

Referring to FIGS. 4A-4G, the firearm handguard member 22 is shown according to an embodiment. The firearm handguard member 22 is defined by a substantially tube-shaped body 74. The substantially tube-shaped body 74 is defined by a distal end surface 76*a*, a proximal end surface 76*b*, an inner axial passage surface 78 and an outer side surface 80.

Figure 4A:
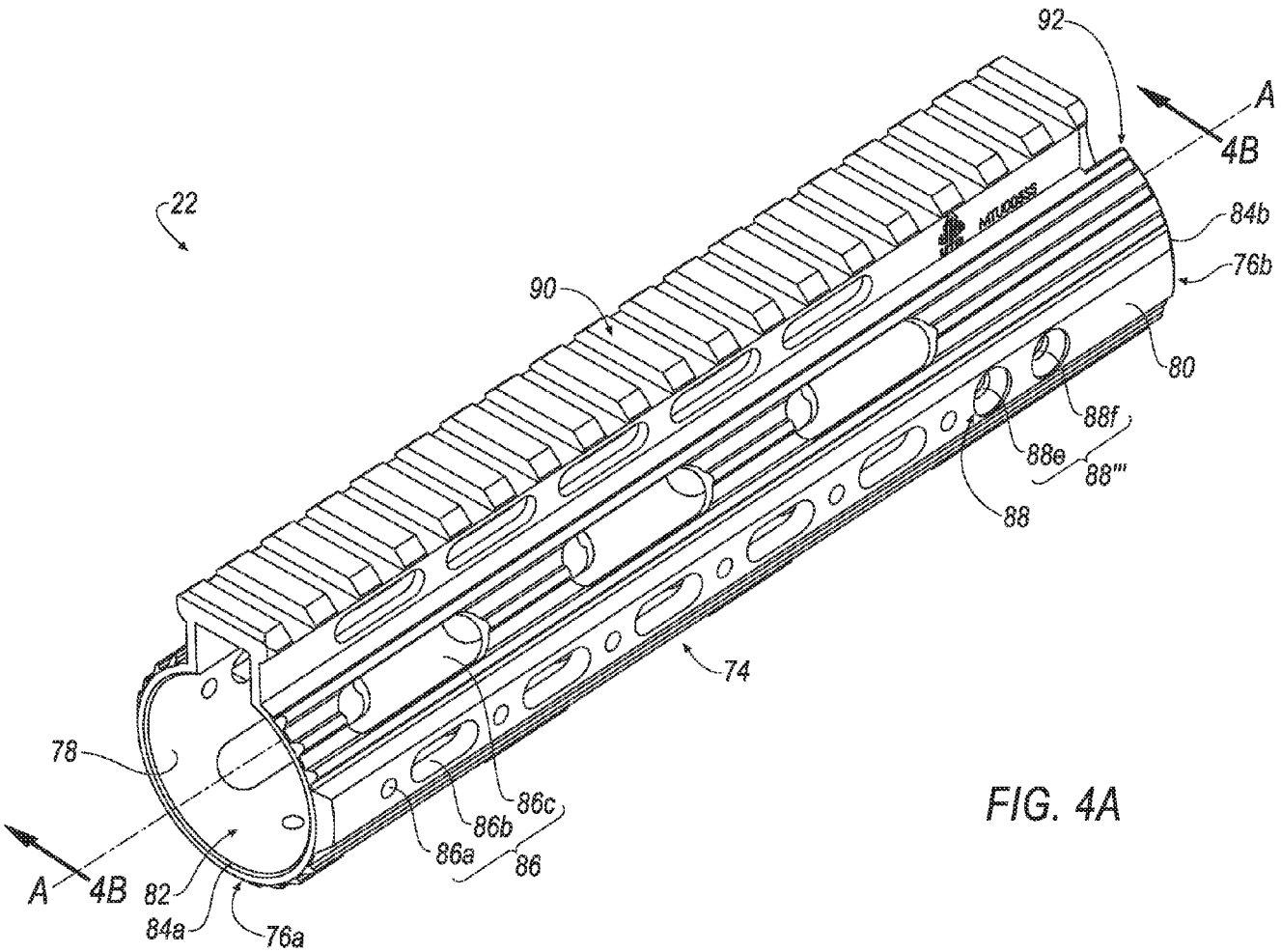
FIGS. 4A-4G are views of an exemplary firearm handguard member of the firearm handguard assembly of FIGS. 1A-1B.
Figure 4B:
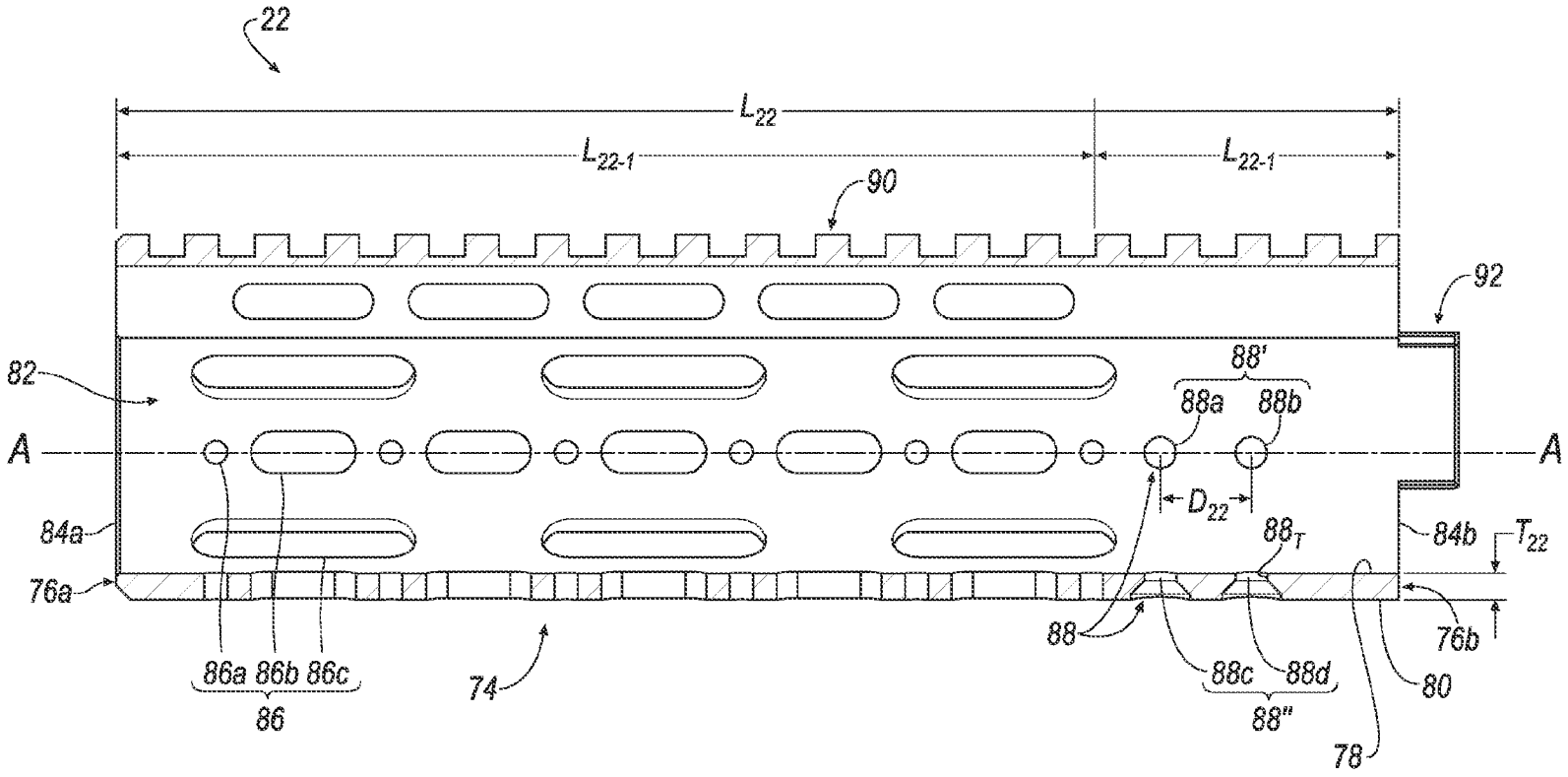
Figure 4D:
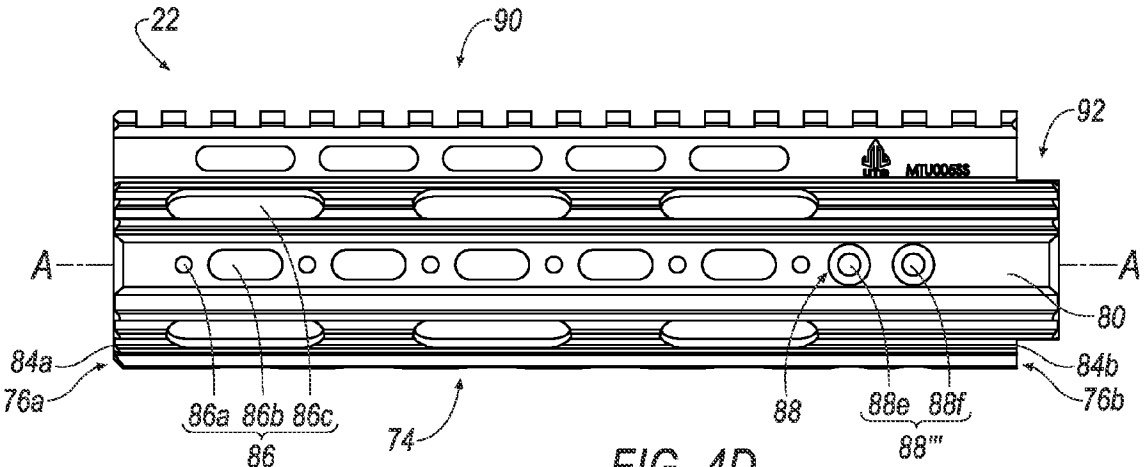
Figure 4F:
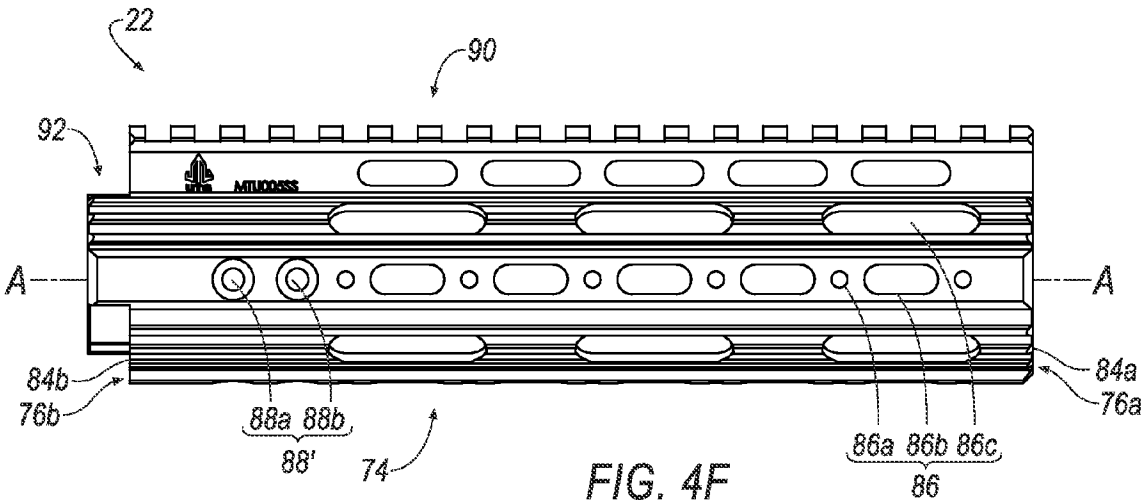
Figure 4C:
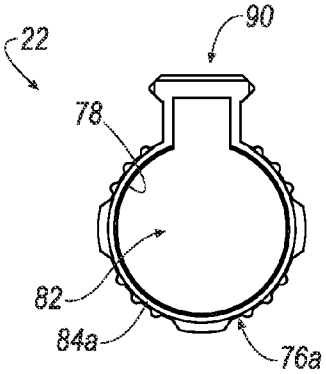
Figure 4E:
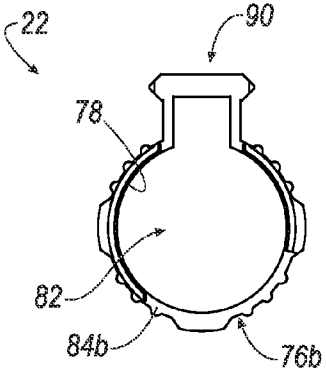
Figure 4G:
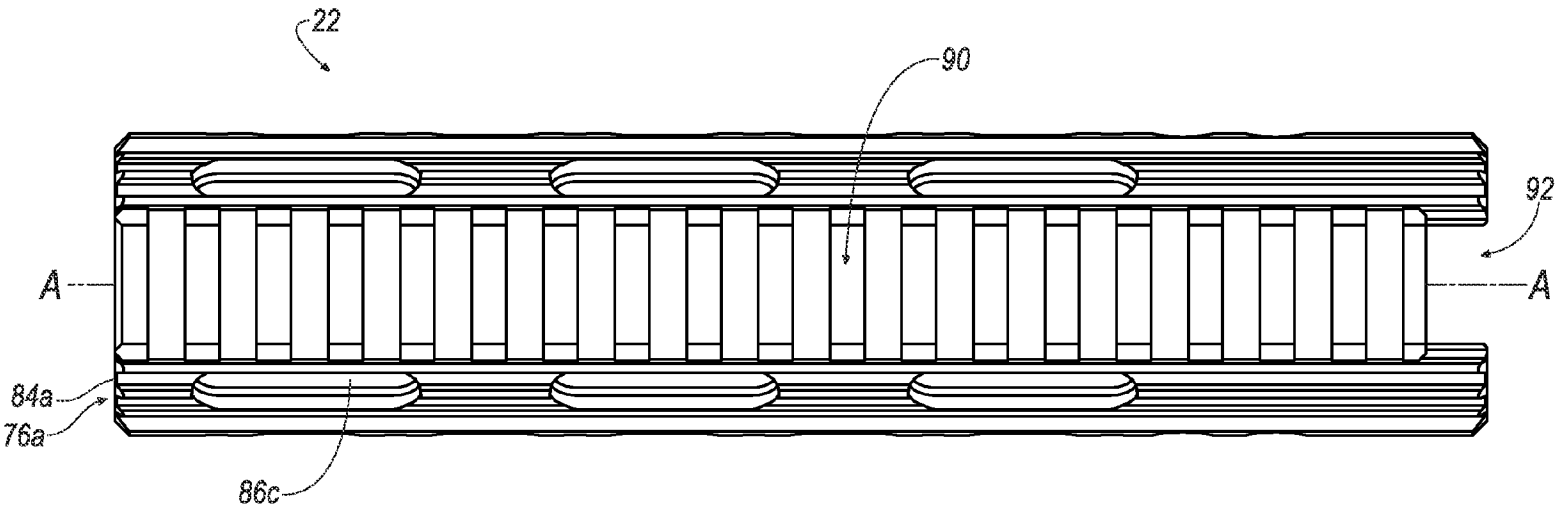
Figure 5A:
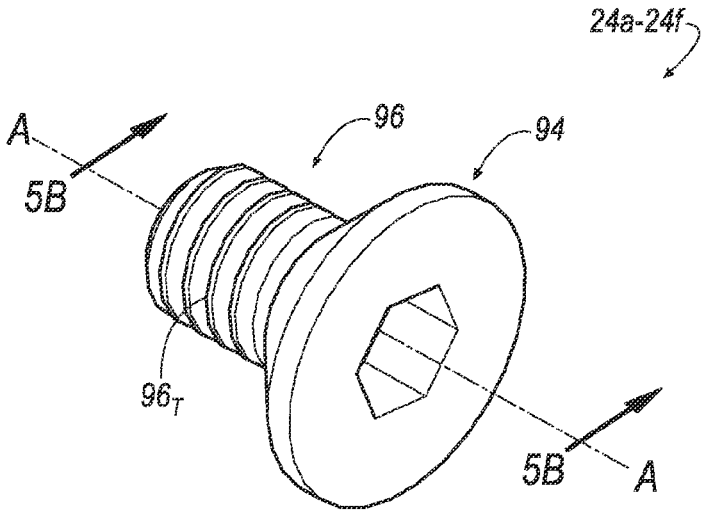
FIGS. 5A-5D are views of an exemplary fastener of the firearm handguard assembly of FIGS. 1A-1B.
Figure 5B:
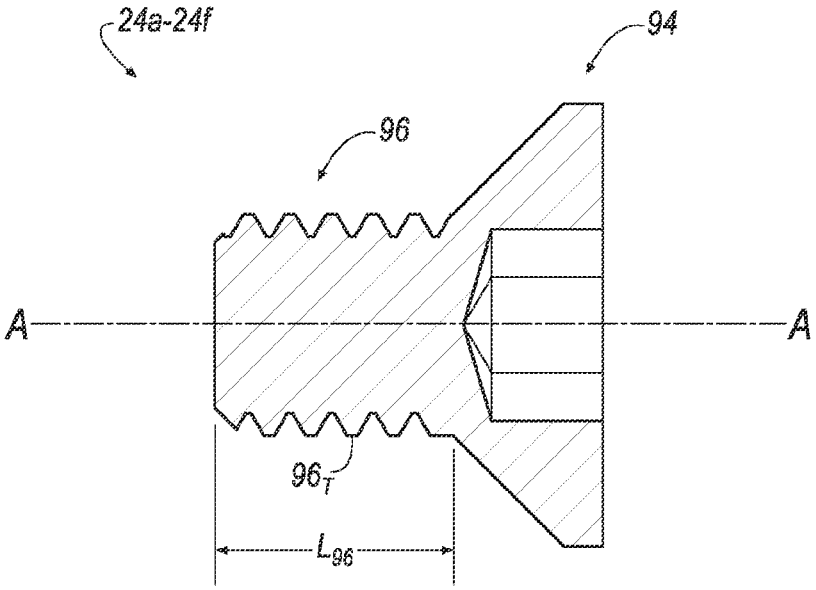
Figure 5C:
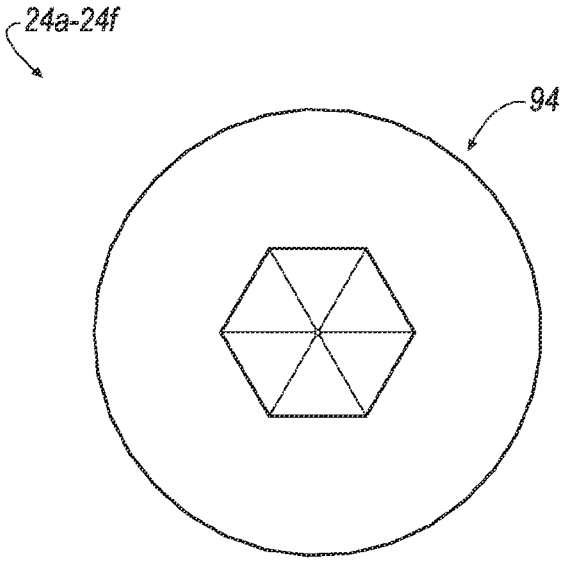
Figure 5D:
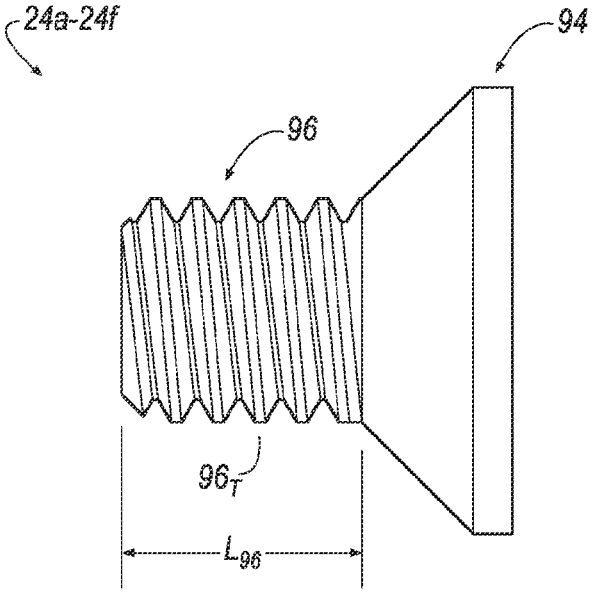

The substantially tube-shaped body 74 may define the firearm handguard member 22 to include a length, $L_{22}$ (see, e.g., FIG. 4B). The length, $L_{22}$, of the firearm handguard member 22 may include a first length portion, $L_{22\text{-}1}$, extending away from the distal end surface 76*a* of the substantially tube-shaped body 74 and a second length portion, $L_{22\text{-}2}$, extending away from the proximal end surface 76*b* of the substantially tube-shaped body 74. The substantially tube-shaped body 74 may also define a thickness, $T_{22}$, of the firearm handguard member 22 extending between the inner axial passage surface 78 and the outer side surface 80.

The inner axial passage surface 78 defines an axial passage 82 that extends through the length, $L_{22}$, of the firearm handguard member 22 along a central axis, A-A, between the distal end surface 76*a* of the substantially tube-shaped body 74 and the proximal end surface 76*b* of the substantially tube-shaped body 74. Access to the axial passage 82 of the firearm handguard member 22 is permitted by a distal axial opening 84*a* formed by the distal end surface 76*a* of the substantially tube-shaped body 74 and a proximal axial opening 84*b* formed by the proximal end surface 76*b* of the substantially tube-shaped body 74.

The first length portion, $L_{22\text{-}1}$, of the length, $L_{22}$, of the firearm handguard member 22 may include a first plurality of radial passages 86. The plurality of radial passages 86 may extend through the thickness, $T_{22}$, of the firearm handguard member 22 such that the plurality of radial passages 86 are in fluid communication with the axial passage 82 that extends through the length, $L_{22}$, of the firearm handguard member 22. In an implementation, the plurality of radial passages 86 may include, for example: a repeating pattern of circular-shaped passages 86*a* and elongated, first oval-shaped passages 86*b*. In an implementation, the plurality of radial passages 86 may also include, for example, a plurality of elongated, second oval-shaped passages 86*c* that are greater in length than the elongated, first oval-shaped passages 86*b*.

The second length portion, $L_{22\text{-}2}$, of the length, $L_{22}$, of the firearm handguard member 22 may include a second plurality of radial passages 88. The second plurality of radial passages 88 may extend through the thickness, $T_{22}$, of the firearm handguard member 22 such that the second plurality of radial passages 88 are in fluid communication with the axial passage 82 that extends through the length, $L_{22}$, of the firearm handguard member 22.

Referring to FIGS. 4A-4B, 4D and 4F, in an implementation, the second plurality of radial passages 88 may include six radial passages 88*a*-88*f* defined by: a first pair of radial passages 88' (see, e.g., FIGS. 4B and 4F) defined by a first radial passage 88*a* and a second radial passage 88*b*, a second pair of radial passages 88" (see, e.g., FIG. 4B) defined by a third radial passage 88*c* and a fourth radial passage 88*d* and a third pair of radial passages 88'" (see, e.g., FIGS. 4A and 4D) defined by a fifth radial passage 88*e* and a sixth radial passage 88*f*. Each passage 88*a*-88*f* of the pairs of passages 88'-88'" may be spaced apart by a distance, $D_{22}$ (see, e.g., FIG. 4B); the spaced apart distance, $D_{22}$, of each passage 88*a*-88*f* of the pairs of passages 88'-88'" may be approximately equal to the spaced apart distance, $D_{20}$, of each passage 72*a*-72*f* of the pairs of passages 72'-72'" of the locking sleeve member 20 and the spaced apart distance, $D_{18}$, of the first and second substantially circumferential passages 50, 52 of the barrel nut member 18.

In an implementation, the first pair of radial passages 88' may be said to be arranged at "the 9 o'clock position" of the firearm handguard member 22. In an implementation, the second pair of radial passages 88" may be said to be arranged at "the 6 o'clock position" of the firearm handguard member 22. In an implementation, the third pair of radial passages 88'" may be said to be arranged at "the 3 o'clock position" of the firearm handguard member 22. Accordingly, in an embodiment, each of the first pair of radial passages 88' and the third pair of radial passages 88'" may be offset from the second pair of radial passages 88" by approximately about 90°.

Each radial passage 88*a*-88*f* of the second plurality of radial passages 88 is defined by a counter-sunk surface portion $\mathbf{88}_c$ (see, e.g., FIG. 4B). As will be described in the following disclosure at FIGS. 6D-6E, the second plurality of radial passages 88 permits the outer threaded surface $\mathbf{96}_T$ of a fastener 24*a*-24*f* of the plurality of fasteners 24 to pass through the handguard member 22 for securing the firearm handguard member 22 to both of the barrel nut member 18 and the locking sleeve member 20.

In an implementation, the "the 12 o'clock position" outer side surface 80 of the firearm handguard member 22 may generally define an implement mounting rail member 90. The implement mounting rail member 90 is formed integrally with the substantially tube-shaped body 74 of the firearm handguard member 22. The implement mounting rail member 90 may include any desirable geometry such as, for example, a "Picatinny" style implement mounting rail. The geometry of the implement mounting rail member 90 is substantially similar to an implement mounting rail member, IR (see, e.g., FIGS. 6A-6G), extending away from a "12 o'clock" position of the firearm, F; therefore, in an implementation, the implement mounting rail member 90 is purposely formed at a "12 o'clock" position of the firearm handguard member 22 such that, as seen in, for example, FIG. 6E, upon joining the firearm handguard assembly 10 to the firearm, F, the implement mounting rail member 90 may be aligned with and further extend the implement mounting rail member, IR, extending away from a "12 o'clock" position of the firearm, F.

If additional implement mounting rails are desired, the one or more supplementary implement mounting rail members 28 may be joined to the outer side surface 80 of the firearm handguard member 22 at "the 3 o'clock," "the 6 o'clock" and "the 9 o'clock" positions of the firearm handguard member 22. Attachment of the one or more supplementary implement mounting rail members 28 may be conducted as seen in FIGS. 1A-1B by inserting a fastener 24 through each supplementary implement mounting rail member 28 and into, for example, one or more of the first plurality of radial passages 86, such as, for example, the circular-shaped passages 86*a* of the first plurality of radial passages 86. Any desirable implement may be attached to the implement mounting rail members 28, 90 such as, for example: a scope, a light emitting device (e.g., a laser) or the like.

Referring to FIGS. 4A-4B, 4D and 4F, in an implementation, the proximal end surface 76*b* of the firearm handguard member 22 may generally define a key-shaped geometry 92. Referring to FIGS. 6C-6D, the key-shaped geometry 92 mates with a corresponding key-shaped geometry, $R_K$, formed proximate one or more of the receiver, R, and the implement mounting rail member, IR, for preventing the firearm handguard member 22 to rotate during use of the firearm, F. The cooperation of the key-shaped geometry 92 with the corresponding key-shaped geometry, $R_K$, of the firearm, F, may also ensure that the "12 o'clock" position of the implement mounting rail member 90 of the firearm handguard member 22 is aligned with the implement mounting rail member, IR, extending away from the "12 o'clock" position of the firearm, F.

Referring to FIGS. 5A-5D, a fastener 24*a*-24*f* of the plurality of fasteners 24 is shown according to an embodiment. The fastener 24*a*-24*f* is defined by a head portion 94 connected to a stem portion 96.

The stem portion 96 includes an outer threaded surface $\mathbf{96}_T$. The stem portion 96 is defined by a length, $L_{96}$. The length, $L_{96}$, of the stem portion 96 is at least approximately equal to about a sum of: the thickness, $T_{18}$, of the barrel nut member 18, the second thickness, $T_{20\text{-}2}$, formed by the substantially tube-shaped body portion 56 of the locking sleeve member 20, and the thickness, $T_{22}$, of the firearm handguard member 22.

As described above, the outer threaded surface $\mathbf{96}_T$ of the stem portion 96 of the fasteners 24*a*-24*f* threadingly-cooperate with the threaded surface $\mathbf{72}_T$ of each radial passage 72*a*-72*f* of the plurality of radial passages 72 of the locking sleeve member 20 and is passed through each radial passage 88*a*-88*f* of the second plurality of radial passages 88 of the firearm handguard member 22 for securing the firearm handguard member 22 to both of the barrel nut member 18 and the locking sleeve member 20.

Referring to FIGS. 6A-6G, a firearm, F, is shown according to an embodiment. FIGS. 6A-6G also illustrates a method for joining the firearm handguard assembly 10 to the firearm, F. In general, the method includes the steps of: (1) connecting the barrel nut member 18 to the receiver, R, of the firearm, F, as seen in FIGS. 6A-6B, (2) connecting the locking sleeve member 20 to the barrel nut member 18 as seen in FIGS. 6B-6C, (3) connecting the firearm handguard member 22 to barrel nut member 18 and the locking sleeve member 20 as seen in FIGS. 6C-6D, and (4) extending a plurality of fasteners 24 through each of the firearm handguard member 22, the locking sleeve member 20 and the barrel nut member 18 for joining the firearm handguard member 22 to the locking sleeve member 20 and the barrel nut member 18, as seen in FIGS. 6D-6E.

Referring to FIGS. 6A-6B, a method for connecting the barrel nut member 18 to the receiver, R, of the firearm, F, is described. As described above, the firearm, F, includes a receiver, R, and a barrel, B; the barrel, B, extends axially away from the receiver, R. In order to connect the barrel nut member 18 to the receiver, R, of the firearm, F, the axial passage 38 of the barrel nut member 18 is axially-aligned with the barrel, B, of the firearm, F. The barrel, B, is arranged within the axial passage 38 of the barrel nut member 18 as the barrel nut member 18 is guided along the barrel, B, of the firearm, F, toward the receiver, R.

As described above, the inner axial passage surface 34 of the second length portion, $L_{18\text{-}2}$, of the barrel nut member 18 includes a threaded surface portion $\mathbf{34}_T$. When the proximal end surface 32*b* of the substantially tube-shaped body 30 of the barrel nut member 18 is arranged adjacent the receiver, R, the barrel nut member 18 is rotated relative to the receiver, R, such that the threaded surface portion $\mathbf{34}_T$ of the barrel nut member 18 will cooperate with the threaded surface, $R_T$, of the receiver, R, in order to threadingly-attach the barrel nut member 18 to the receiver, R, as seen in FIG. 6B.

Referring to FIGS. 6B-6C, a method for connecting the locking sleeve member 20 to the barrel nut member 18 is described. In order to connect the locking sleeve member 20 to the barrel nut member 18: (1) the axial passage 66 of the locking sleeve member 20 is axially-aligned with the barrel, B, of the firearm, F, and (2) the radial passage 70 formed along the length, $L_{20}$, of the locking sleeve member 20 is aligned with the "12 o'clock" position of the barrel, B, of the firearm, F. As the locking sleeve member 20 is guided (1) along the barrel, B, and (2) along the "12 o'clock" position of the firearm, F, toward the barrel nut member 18 that is attached receiver, R, as described above in FIGS. 6A-6B, (1) the barrel, B, is arranged within the axial passage 66 of the locking sleeve member 20, as the lock sleeve member 20 is maintained (2) the about the "12 o'clock" position of the firearm, F.

As the locking sleeve member 20 is continued to be guided along the barrel, B, and about the "12 o'clock" position of the firearm, F, the substantially tube-shaped body portion 56 of the locking sleeve member 20 is eventually arranged within the axial passage 38 of the barrel nut member 18 (as seen in FIG. 6C) due to the substantially tube-shaped body portion 56 being defined by a diameter that is approximately equal to but less than a diameter defined by the axial passage 38 of the barrel nut member 18. The locking sleeve member 20 may be continued to be guided into the axial passage 38 of the barrel nut member 18 until the ledge surface 64 of the substantially circumferential lip portion 54 of the locking sleeve member 20 is disposed adjacent the distal end surface 32*a* of the substantially tube-shaped body 30 of the barrel nut member 18. Once the ledge surface 64 of the substantially circumferential lip portion 54 of the locking sleeve member 20 is disposed adjacent the distal end surface 32*a* of the substantially tube-shaped body 30 of the barrel nut member 18, the plurality of radial passages 72 formed by the locking sleeve member 20 are aligned with the plurality of radial passages 42 formed by the barrel nut member 18.

Referring to FIGS. 6C-6D, a method for connecting the firearm handguard member 22 to barrel nut member 18 and the locking sleeve member 20 is described. In order to connect the firearm handguard member 22 to barrel nut member 18 and the locking sleeve member 20: (1) the axial passage 82 of the firearm handguard member 22 is axially-aligned with the barrel, B, of the firearm, F, and (2) the implement mounting rail member 90 of the firearm handguard member 22 is aligned with the implement mounting rail member, IR, formed at the "12 o'clock" position of the firearm, F. As the firearm handguard member 22 is guided along the barrel, B, of the firearm, F, toward the locking sleeve member 20 attached to the barrel nut member 18, as described above in FIGS. 6B-6C, the barrel, B, is arranged within the axial passage 82 of the firearm handguard member 22.

As the firearm handguard member 22 is continued to be guided along the barrel, B, of the firearm, F, the key-shaped geometry 92 defined by the proximal end surface 76*b* of the firearm handguard member 22 eventually is received by and mates with the corresponding key-shaped geometry, $R_K$, of the firearm, F. When the key-shaped geometry 92 of the firearm handguard member 22 is received by and mates with the corresponding key-shaped geometry, $R_K$, of the firearm, F, the firearm handguard member 22 is arranged about the locking sleeve member 20 and the barrel nut member 18 such that the locking sleeve member 20 and the barrel nut member 18 are arranged within the axial passage 82 of the firearm handguard member 22. Upon arranging the firearm handguard member 22 about the locking sleeve member 20 and the barrel nut member 18, the plurality of radial passages 88 of the firearm handguard member 22 are aligned with the plurality of radial passages 72 of the locking sleeve member 20 and the plurality of radial passages 42 of the barrel nut member 18.

Referring to FIGS. 6D-6E, the firearm handguard member 22 is joined to the locking sleeve member 20 and the barrel nut member 18 by extending the plurality of fasteners 24 through the plurality of aligned radial passages 42, 72, 88 of each of the firearm handguard member 22, the locking sleeve member 20 and the barrel nut member 18. As seen in FIG. 6D, the stem portion 96 of each fasteners 24*a*-24 of the plurality of fasteners 24 is aligned with each aligned radial passages of the plurality of aligned radial passages 42, 72, 88 formed by the barrel nut member 18, the locking sleeve member 20 and the firearm handguard member 22. Then, as seen in FIG. 6E, the stem portion 96 of each fasteners 24*a*-24 of the plurality of fasteners 24 is inserted (1) firstly through the plurality of radial passages 88 of the firearm handguard member 22, then (2) secondly through the plurality of radial passages 42 of the barrel nut member 18 and then (3) thirdly through the plurality of radial passages 72 of the locking sleeve member 20 for joining the firearm handguard member 22 to the barrel nut member 18 and the locking sleeve member 20. The plurality of fasteners 24 joins the firearm handguard member 22 to the locking sleeve member 20 and the barrel nut member 18 as a result of the outer threaded surface $96_T$ of the stem portion 96 of each fasteners 24*a*-24*f* threadingly-cooperating with the threaded surface $72_T$ of each radial passage 72*a*-72*f* of the plurality of radial passages 72 of the locking sleeve member 20 and also by being passed through each radial passage 88*a*-88*f* of the second plurality of radial passages 88 of the firearm handguard member 22.

Once the plurality of fasteners 24 joins the firearm handguard member 22 to the locking sleeve member 20 and the barrel nut member 18, the firearm handguard assembly 10 may said to be assembled upon the firearm, F. As seen in FIG. 1C"", the barrel, B, is shown in phantom extending through the firearm handguard assembly 10 such that at least, for example, the inner surface 78 of the handguard member 22 is arranged in a spaced-apart, "free floating" relationship with respect to an exterior surface of the barrel, B.

In some implementations, if the radial passage 72*a*-72*f* of the plurality of radial passages 72 of the locking sleeve member 20 and the radial passage 88*a*-88*f* of the second plurality of radial passages 88 of the firearm handguard member 22 are not aligned with one another after connecting the firearm handguard member 22 to barrel nut member 18 and the locking sleeve member 20 as seen in FIGS. 6C-6D, the plurality of fasteners 24 may be prohibited from extending through the plurality of radial passages 42, 72, 88 of the barrel nut member 18, the locking sleeve member 20 and the firearm handguard member 22. Therefore, in such a circumstance, the barrel nut member 18, the locking sleeve member 20 and the firearm handguard member 22 may be disconnected from the firearm, F, in order to arrange the shim ring 26 between the barrel lip and barrel nut member 18. Once the shim ring 26 is disposed between the barrel lip and barrel nut member 18, the locking sleeve member 20 and the firearm handguard member 22 may be reconnected to the firearm, F, as described above at FIGS. 6A-6C. As a result of the inclusion of the shim ring 26 between the barrel lip and barrel nut member 18, plurality of radial passages 42, 72, 88 of the barrel nut member 18, the locking sleeve member 20 and the firearm handguard member 22 may be aligned with one another in order to permit the plurality of fasteners 24 to be extended through each of the firearm handguard member 22, the locking sleeve member 20 and the barrel nut member 18 for joining the firearm handguard member 22 to the locking sleeve member 20 and the barrel nut member 18, as seen in FIGS. 6D-6E.

Figure 6F:
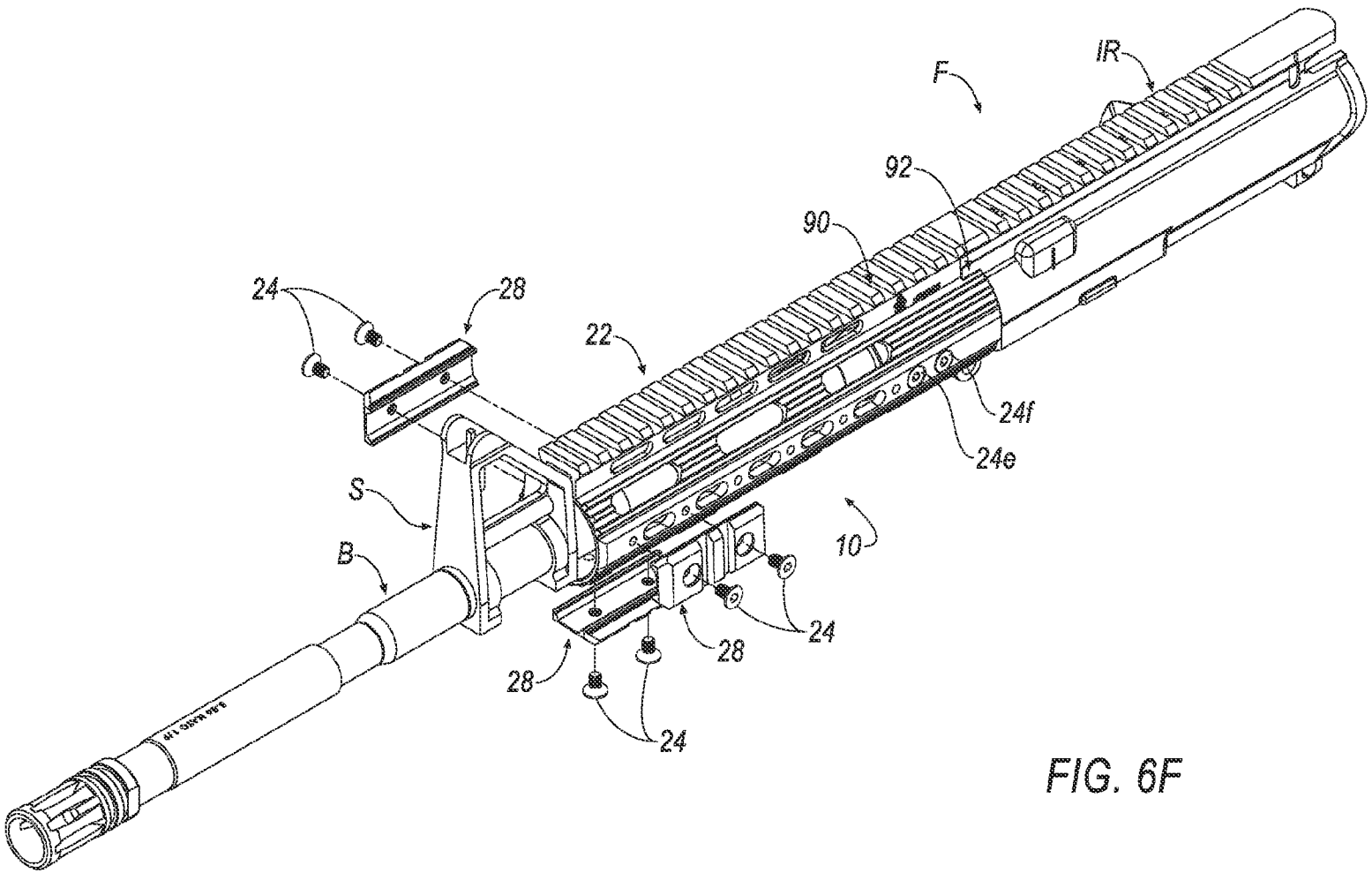

Referring to FIGS. 6E-6F, once the firearm handguard assembly 10 is joined to the firearm, F, as described above at FIGS. 6D-6E, a sight member, S, including a gas tube, GT, attached thereto may be optionally attached to the barrel, B, of the firearm, F, proximate the distal end surface 10*a* of the firearm handguard assembly 10. As seen in FIG. 1C"", the sight member, S, and the gas tube, GT, are shown in phantom; the gas tube, GT, extends from the sight member, S, through the firearm handguard assembly 10 and attaches (not shown) to the firearm, F, proximate the receiver, R. As seen in FIG. 1C"", the gas tube, GT, extends along the "12 o'clock" position of the barrel of the firearm, F, and over the barrel nut member 18 and locking sleeve member 20.

Figure 6G:
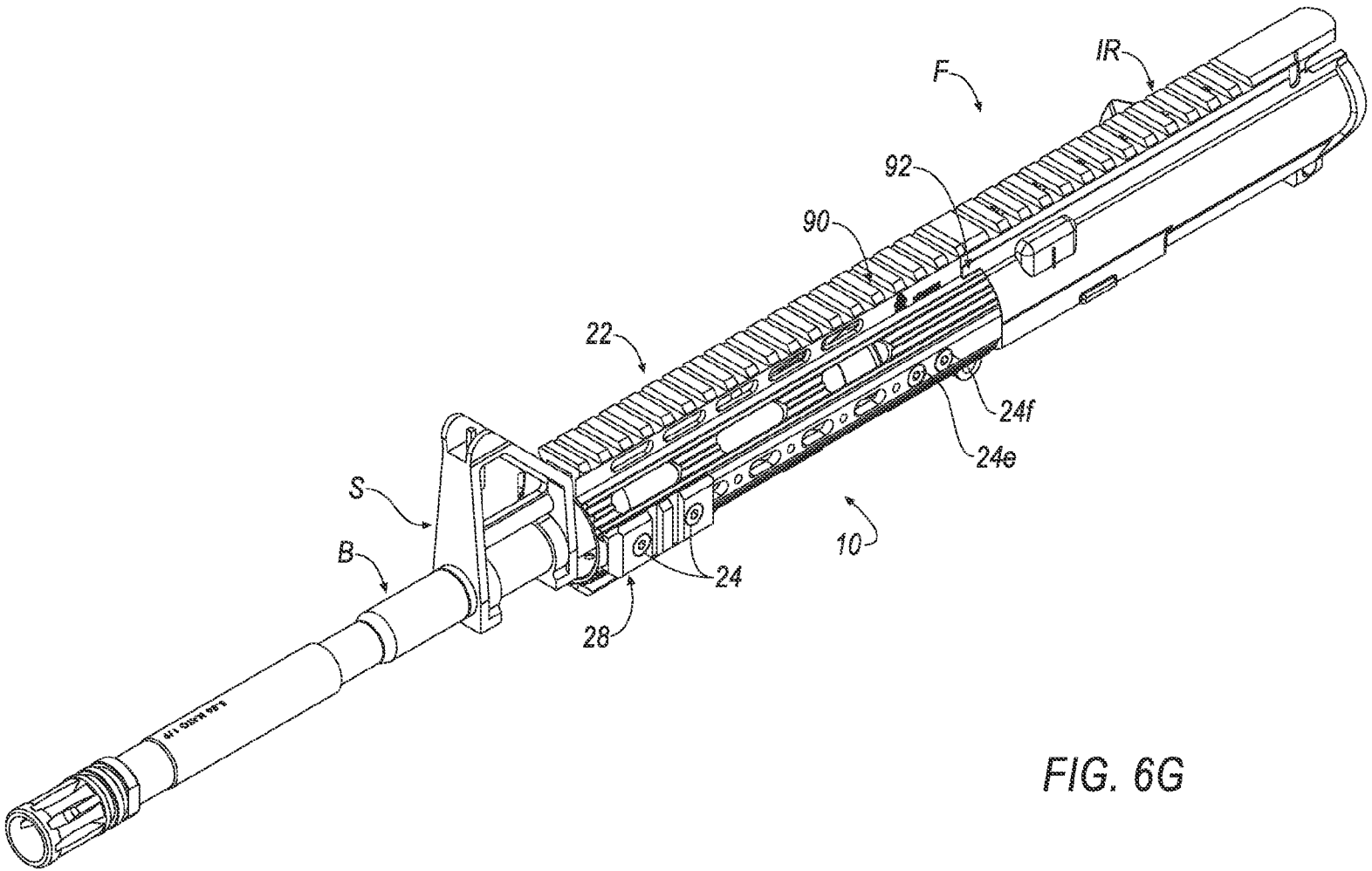

Referring to FIGS. 6F-6G, once the firearm handguard assembly 10 is joined to the firearm, F, as described above at FIGS. 6D-6E, one or more supplementary implement mounting rail members 28 may be optionally attached to the firearm handguard member 22. The one or more supplementary implement mounting rail members 28 may be joined to the outer side surface 80 of the firearm handguard member 22 at "the 3 o'clock," "the 6 o'clock" and "the 9 o'clock" positions of the firearm handguard member 22. Attachment of the one or more supplementary implement mounting rail members 28 may be conducted by inserting a fastener 24 (substantially similar to the fasteners 24*a*-24*f*) through each supplementary implement mounting rail member 28 and into one or more of the first plurality of radial passages 86, such as, for example, the circular-shaped passages 86*a* of the first plurality of radial passages 86.

Attachment of the firearm handguard assembly 10 to the firearm, F, as described above at FIGS. 6A-6E provides several advantageous features. For example, one advantageous aspect permits simplified installation of the firearm handguard assembly 10 upon the firearm, F, as the user does not have to index the barrel nut member 18 for alignment with, for example, the gas tube, GT, which is located at approximately about the "12 o'clock" position of the firearm, F. One advantageous aspect of the barrel nut member 18 provides an extremely rugged attachment to the receiver, R, of the firearm, F, in order to permit the firearm handguard member 22 to "free float" with respect to the barrel, B, of the firearm, F, thereby permitting heat generated by the barrel, B, to escape to the surrounding atmosphere while also preventing a user from directly touching the barrel, B, which may have a temperature higher than ambient temperature after the firearm, F, discharges a round of ammunition. Another advantageous aspect of the barrel nut member 18 results in the elimination of harmonic disruption from the firearm handguard member 22 onto the barrel, B, of the firearm, F. In another example, the firearm handguard assembly 10 also offers an uninterrupted "12 o'clock" position implement mounting rail 90 in combination with the implement mounting rail, IR, of the firearm, F, in order to permit the firearm, F, to have expanded implement mounting solutions. In yet another example, the cooperation of the key-shaped geometry 92 of the firearm handguard member 22 with the corresponding key-shaped geometry, $R_K$, of the firearm, F, results in the firearm handguard assembly 10 providing an anti-rotational extension that prevents any accidental rotation of the firearm handguard assembly 10 with respect to the barrel, B, during operation of the firearm, F. In another example, the one or more supplementary implement mounting rail members 28 may be joined to the outer side surface 80 of the firearm handguard member 22 in order to provide customizable implement mounting rail members 28 at one or more of the "3 o'clock," "6 o'clock" and "9 o'clock" positions depending on preference of the user.

A number of implementations have been described. Nevertheless, it will be understood that various modifications may be made without departing from the spirit and scope of the disclosure. Accordingly, other implementations are within the scope of the following claims. For example, the actions recited in the claims can be performed in a different order and still achieve desirable results.

What is claimed is:

1. A firearm handguard assembly attachable to a receiver of a barrel of a firearm, comprising:

a barrel nut member;

a locking sleeve member disposed within an axial passage formed by the barrel nut member, wherein a plurality of radial passages of the locking sleeve member are aligned with a plurality of radial passages of the barrel nut member;

a firearm handguard member arranged about the barrel nut member and the locking sleeve member such that the barrel nut member and the locking sleeve member are arranged within an axial passage of the firearm handguard member, wherein a plurality of radial passages of the firearm handguard member are aligned with the plurality of radial passages of the locking sleeve member and the plurality of radial passages of the barrel nut member;

a plurality of fasteners extending through the plurality of radial passages of the barrel nut member, the locking sleeve member and the firearm handguard member for joining the firearm handguard member to the barrel nut member and the locking sleeve member.

2. The firearm handguard assembly of claim 1, wherein the plurality of fasteners are inserted: firstly through the plurality of radial passages of the firearm handguard member, then secondly through the plurality of radial passages of the barrel nut member and then thirdly through the plurality of radial passages of the locking sleeve member for joining the firearm handguard member to the barrel nut member and the locking sleeve member.

3. The firearm handguard assembly of claim 1, wherein the plurality of radial passages of the locking sleeve member extend through a thickness of the locking sleeve member such that the plurality of radial passages of the locking sleeve member are in fluid communication with an axial passage that extends through the length of the locking sleeve member.

4. The firearm handguard assembly of claim 1, wherein the plurality of radial passages of the firearm handguard member extend through a thickness of the firearm handguard member such that the plurality of radial passages of the firearm handguard member are in fluid communication with an axial passage that extends through the length of the firearm handguard member.

5. The firearm handguard assembly of claim 1, wherein the plurality of radial passages of the barrel nut member includes a first radial passage, a second radial passage, a third radial passage and a fourth radial passage, wherein the first radial passage and the second radial passage are arranged in an opposing relationship to thereby define the substantially tube-shaped body to include a first substantially circumferential passage, wherein the third radial passage and the fourth radial passage are arranged in an opposing relationship to thereby define the substantially tube-shaped body to include a second substantially circumferential passage, wherein the first substantially circumferential passage and the second substantially circumferential passage are spaced apart by a first spaced-apart distance.

6. The firearm handguard assembly of claim 5, wherein the plurality of radial passages of the locking sleeve member include six radial passages defined by:

a first pair of radial passages defined by a first radial passage and a second radial passage, a second pair of radial passages defined by a third radial passage and a fourth radial passage, and a third pair of radial passages defined by a fifth radial passage and a sixth radial passage, wherein each passage of the first, second and third pairs of passages of the locking sleeve member are spaced apart by a second spaced-apart distance, wherein the second spaced-apart distance is approximately equal to the first spaced-apart distance.

7. The firearm handguard assembly of claim 6, wherein each of the first pair of radial passages of the locking sleeve member and the third pair of radial passages of the locking sleeve member are offset by approximately 90° from the second pair of radial passages of the locking sleeve member.

8. The firearm handguard assembly of claim 7, wherein the first pair of radial passages of the locking sleeve member are arranged at a "3 o'clock position" of the locking sleeve member, wherein the second pair of radial passages of the locking sleeve member are arranged at a 6 o'clock position of the locking sleeve member, wherein the third pair of radial passages of the locking sleeve member are arranged at a "9 o'clock position" of the locking sleeve member.

9. The firearm handguard assembly of claim 6, wherein the plurality of radial passages of the firearm handguard member include six radial passages defined by:

a first pair of radial passages defined by a first radial passage and a second radial passage, a second pair of radial passages defined by a third radial passage and a fourth radial passage, and a third pair of radial passages defined by a fifth radial passage and a sixth radial passage, wherein each passage of the first, second and third pairs of passages of the firearm handguard member are spaced apart by a third spaced-apart distance, wherein the third spaced-apart distance is approximately equal to each of the second spaced-apart distance and the first spaced-apart distance.

10. The firearm handguard assembly of claim 9, wherein each of the first pair of radial passages of the firearm handguard member and the third pair of radial passages of the firearm handguard member are offset by approximately 90° from the second pair of radial passages of the firearm handguard member.

11. The firearm handguard assembly of claim 10, wherein the first pair of radial passages of the firearm handguard member are arranged at a "3 o'clock position" of the firearm handguard member, wherein the second pair of radial passages of the firearm handguard member are arranged at a "6 o'clock position" of the firearm handguard member, wherein the third pair of radial passages of the firearm handguard member are arranged at a "9 o'clock position" of the firearm handguard member.

12. The firearm handguard assembly of claim 1, wherein the barrel nut member is defined by a substantially tube-shaped body having a distal end surface, a proximal end surface, an inner axial passage surface and an outer side surface.

13. The firearm handguard assembly of claim 12, wherein each radial passage of the plurality of radial passages of the barrel nut member defines an arcuate-shaped dimension that extends along slightly less than about 180° of the substantially tube-shaped body.

14. The firearm handguard assembly of claim 12, wherein the inner axial passage surface of the barrel nut member includes a threaded surface portion that corresponds to and is threadingly-connectable with a threaded surface of the receiver of the firearm.

15. The firearm handguard assembly of claim 12, wherein the substantially tube-shaped body defines the barrel nut member to include a length including a first length portion extending away from the distal end surface of the substantially tube-shaped body and a second length portion extending away from the proximal end surface of the substantially tube-shaped body, wherein the substantially tube-shaped body defines a thickness of the barrel nut member extending between the inner axial passage surface and the outer side surface, wherein the inner axial passage surface of the barrel nut member defines the axial passage of the barrel nut member that extends through the length of the barrel nut member between the distal end surface of the substantially tube-shaped body and the proximal end surface of the substantially tube-shaped body, wherein the axial passage of the barrel nut member is permitted by a distal axial opening formed by the distal end surface of the substantially tube-shaped body and a proximal axial opening formed by the proximal end surface of the substantially tube-shaped body.

16. The firearm handguard assembly of claim 15, wherein the first length portion of the barrel nut member includes the plurality of radial passages of the barrel nut member, wherein the plurality of radial passages extend through the thickness of the barrel nut member such that the plurality of radial passages are in fluid communication with the axial passage that extends through the length of the barrel nut member.

17. The firearm handguard assembly of claim 1, wherein the locking sleeve member forms a radial passage that extends along an entire length locking sleeve member.

18. The firearm handguard assembly of claim 17, wherein the radial passage is arranged at a 12 o'clock position of the locking sleeve member.

19. The firearm handguard assembly of claim 1, wherein the locking sleeve member is defined by a substantially circumferential lip portion, and a substantially tube-shaped body portion connected to the substantially circumferential lip portion, wherein the substantially circumferential lip portion defines a distal end surface of the locking sleeve member, wherein the substantially tube-shaped body portion defines a proximal end surface of the locking sleeve member, wherein both of the substantially circumferential lip portion and the substantially tube-shaped body portion define an inner axial passage surface of the locking sleeve member, wherein both of the substantially circumferential lip portion and the substantially tube-shaped body portion define an outer side surface of the locking sleeve member, wherein the substantially circumferential lip portion includes a ledge surface that connects a first portion of the outer side surface that is defined by the substantially circumferential lip portion to a second portion of the outer side surface that is defined by the substantially tube-shaped body portion, wherein the ledge surface demarcates the substantially circumferential lip portion from the substantially tube-shaped body portion.

20. The firearm handguard assembly of claim 19, wherein the locking sleeve member includes a length, wherein the substantially circumferential lip portion of the locking sleeve member defines a first length portion of the length of the locking sleeve member that extends away from the distal end surface of the locking sleeve member, wherein the substantially tube-shaped body portion of the locking sleeve member defines a second length portion of the length of the locking sleeve member that extends away from the proximal end surface of the locking sleeve member, wherein the substantially circumferential lip portion defines a first thickness of the locking sleeve member extending between the inner axial passage surface and the outer side surface, wherein the substantially tube-shaped body portion defines a second thickness of the locking sleeve member extending between the inner axial passage surface and the outer side surface, wherein the first thickness of the locking sleeve member is greater than the second thickness of the locking sleeve member.

21. The firearm handguard assembly of claim 20, wherein the inner axial passage surface of the locking sleeve member defines an axial passage that extends through the length of the locking sleeve member between the distal end surface of the locking sleeve member and the proximal end surface of the locking sleeve member, wherein access to the axial passage of the locking sleeve member is permitted by a distal axial opening formed by the distal end surface of the substantially circumferential lip portion and a proximal axial opening formed by the proximal end surface of the substantially tube-shaped body portion.

22. The firearm handguard assembly of claim 1, wherein the firearm handguard member is defined by a substantially tube-shaped body having a distal end surface, a proximal end surface, an inner axial passage surface and an outer side surface, wherein the substantially tube-shaped body of the firearm handguard member defines a length of the firearm handguard member, wherein the length of the firearm handguard member includes a first length portion extending away from the distal end surface of the substantially tube-shaped body and a second length portion extending away from the proximal end surface of the substantially tube-shaped body, wherein the substantially tube-shaped body define a thickness of the firearm handguard member extending between the inner axial passage surface of the firearm handguard member and the outer side surface of the firearm handguard member, wherein the inner axial passage surface of the firearm handguard member defines an axial passage of the firearm handguard member that extends through the length of the firearm handguard member between the distal end surface of the substantially tube-shaped body and the proximal end surface of the substantially tube-shaped body, wherein access to the axial passage of the firearm handguard member is permitted by a distal axial opening formed by the distal end surface of the substantially tube-shaped body of the firearm handguard member and a proximal axial opening formed by the proximal end surface of the substantially tube-shaped body of the firearm handguard member.

23. The firearm handguard assembly of claim 22, wherein the first length portion of the length of the firearm handguard member includes a plurality of repeating radial passages that extend through the thickness of the firearm handguard member such that the plurality of repeating radial passages are in fluid communication with the axial passage that extends through the length of the firearm handguard member, wherein the plurality of repeating radial passages include, for example, a repeating pattern of circular-shaped passages, elongated first oval-shaped passages and elongated second oval-shaped passages that are greater in length than the elongated, first oval-shaped passages.

24. The firearm handguard assembly of claim 22, wherein the second length portion of the length of the firearm handguard member includes the plurality of radial passages of the firearm handguard member.

25. The firearm handguard assembly of claim 22, wherein the outer side surface of the firearm handguard member defines an implement mounting rail member.

26. The firearm handguard assembly of claim 25, wherein a "the 12 o'clock position" of the outer side surface of the firearm handguard member includes the implement mounting rail member.

27. The firearm handguard assembly of claim 22, wherein the proximal end surface of the firearm handguard member defines a keyed geometry that mates with a corresponding keyed geometry formed by the receiver of the firearm, wherein the firearm handguard assembly further comprises:

one or more supplementary implement mounting rail members attached to the outer surface of the firearm handguard member.

28. The firearm handguard assembly of claim 27, wherein the one or more supplementary implement mounting rail members is/are arranged upon one or more of a "3 o'clock position", a "6 o'clock position" and a "9 o'clock position" of the outer surface of the firearm handguard member.

29. The firearm handguard assembly of claim 1, wherein the plurality of radial passages of the locking sleeve member are defined by a threaded surface portion that correspond to and is threadingly-connected to an outer threaded surface of each fastener of the plurality of fasteners for securing the firearm handguard member to both of the barrel nut member and the locking sleeve member.

* * * * *